US008579476B2

(12) United States Patent
Mahalingam et al.

(10) Patent No.: US 8,579,476 B2
(45) Date of Patent: Nov. 12, 2013

(54) THERMAL MANAGEMENT OF LED-BASED ILLUMINATION DEVICES WITH SYNTHETIC JET EJECTORS

(75) Inventors: Raghavendran Mahalingam, Austin, TX (US); Samuel N. Heffington, Austin, TX (US); Stephen P. Darbin, Austin, TX (US); Daniel N. Grimm, Round Rock, TX (US)

(73) Assignee: Nuventix, Inc., Austin, TX (US)

( * ) Notice: Subject to any disclaimer, the term of this patent is extended or adjusted under 35 U.S.C. 154(b) by 362 days.

(21) Appl. No.: 12/902,295

(22) Filed: Oct. 12, 2010

(65) Prior Publication Data

US 2011/0089804 A1 Apr. 21, 2011

Related U.S. Application Data

(63) Continuation-in-part of application No. 12/503,181, filed on Jul. 15, 2009, now abandoned.

(60) Provisional application No. 61/134,984, filed on Jul. 15, 2008.

(51) Int. Cl.
*F21V 29/02* (2006.01)

(52) U.S. Cl.
USPC ..... 362/373; 362/294; 362/249.02; 361/697

(58) Field of Classification Search
USPC ..... 362/373, 294, 249.02, 345, 264, 218, 362/126, 547, 580, 800; 361/688–690, 692, 361/695, 697
See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 5,758,823 | A * | 6/1998 | Glezer et al. | 239/4 |
| 7,401,945 | B2 * | 7/2008 | Zhang | 362/249.01 |
| 7,568,817 | B2 * | 8/2009 | Lee et al. | 362/294 |
| 7,637,636 | B2 * | 12/2009 | Zheng et al. | 362/294 |
| 8,066,410 | B2 * | 11/2011 | Booth et al. | 362/294 |
| 8,299,691 | B2 * | 10/2012 | Grimm | 361/697 |
| 8,317,358 | B2 * | 11/2012 | Chou | 362/218 |

* cited by examiner

*Primary Examiner* — Bao Q Truong
(74) *Attorney, Agent, or Firm* — John A. Fortkort; Fortkort & Houston P.C.

(57) ABSTRACT

An illumination device (b1-01) is provided which comprises a housing (b1-03) equipped with an aperture (b1-37), first (b1-33) and second (b1-35) diaphragms disposed in said housing and in fluidic communication with said aperture, and an LED (b1-15) disposed between said first and second diaphragms.

28 Claims, 33 Drawing Sheets

THERMAL MANAGEMENT OF LED-BASED ILLUMINATION DEVICES WITH SYNTHETIC JET EJECTORS

CROSS-REFERENCE TO RELATED APPLICATIONS

The present application is a continuation-in-part of U.S. Ser. No. 12/503,181, entitled "THERMAL MANAGEMENT OF LED-BASED ILLUMINATION DEVICES WITH SYNTHETIC JET EJECTORS" (Heffington et al.), filed on Jul. 15, 2009, now abandoned and which is incorporated herein by reference in its entirety, and which claims priority to U.S. Ser. No. 61/134,984, entitled "THERMAL MANAGEMENT OF LED-BASED ILLUMINATION DEVICES WITH SYNTHETIC JET EJECTORS" (Heffington et al.), filed on Jul. 15, 2008, and which is incorporated herein by reference in its entirety.

FIELD OF THE DISCLOSURE

The present disclosure relates generally to the thermal management of illumination devices, and more particularly to the thermal management of LED-based illumination devices through the use of synthetic jet ejectors.

BACKGROUND OF THE DISCLOSURE

A variety of thermal management devices are known to the art, including conventional fan based systems, piezoelectric systems, and synthetic jet ejectors. The latter type of system has emerged as a highly efficient and versatile solution where thermal management is required at the local level. Frequently, synthetic jet ejectors are utilized in conjunction with a conventional fan based system. In such hybrid systems, the fan based system provides a global flow of fluid through the device being cooled, while the synthetic jet ejectors provide localized cooling for hot spots, and also augment the global flow of fluid within the device through the perturbation of boundary layers.

Various examples of synthetic jet ejectors are known to the art. Some examples include those disclosed in U.S. 20070141453 (Mahalingam et al.) entitled "Thermal Management of Batteries using Synthetic Jets"; U.S. 20070127210 (Mahalingam et al.), entitled "Thermal Management System for Distributed Heat Sources"; 20070119575 (Glezer et al.), entitled "Synthetic Jet Heat Pipe Thermal Management System"; 20070119573 (Mahalingam et al.), entitled "Synthetic Jet Ejector for the Thermal Management of PCI Cards"; 20070096118 (Mahalingam et al.), entitled "Synthetic Jet Cooling System for LED Module"; 20070081027 (Beltran et al.), entitled "Acoustic Resonator for Synthetic Jet Generation for Thermal Management"; and 20070023169 (Mahalingam et al.), entitled "Synthetic Jet Ejector for Augmentation of Pumped Liquid Loop Cooling and Enhancement of Pool and Flow Boiling".

DETAILED DESCRIPTION

The devices and methodologies disclosed herein may be further understood with reference to the particular, non-limiting embodiments of the illumination devices depicted in FIGS. 1 through 33 herein. In these figures, like elements have been given like numerical identifiers. A listing of the numerical identifiers is attached hereto as APENDIX A.

Figure 1:
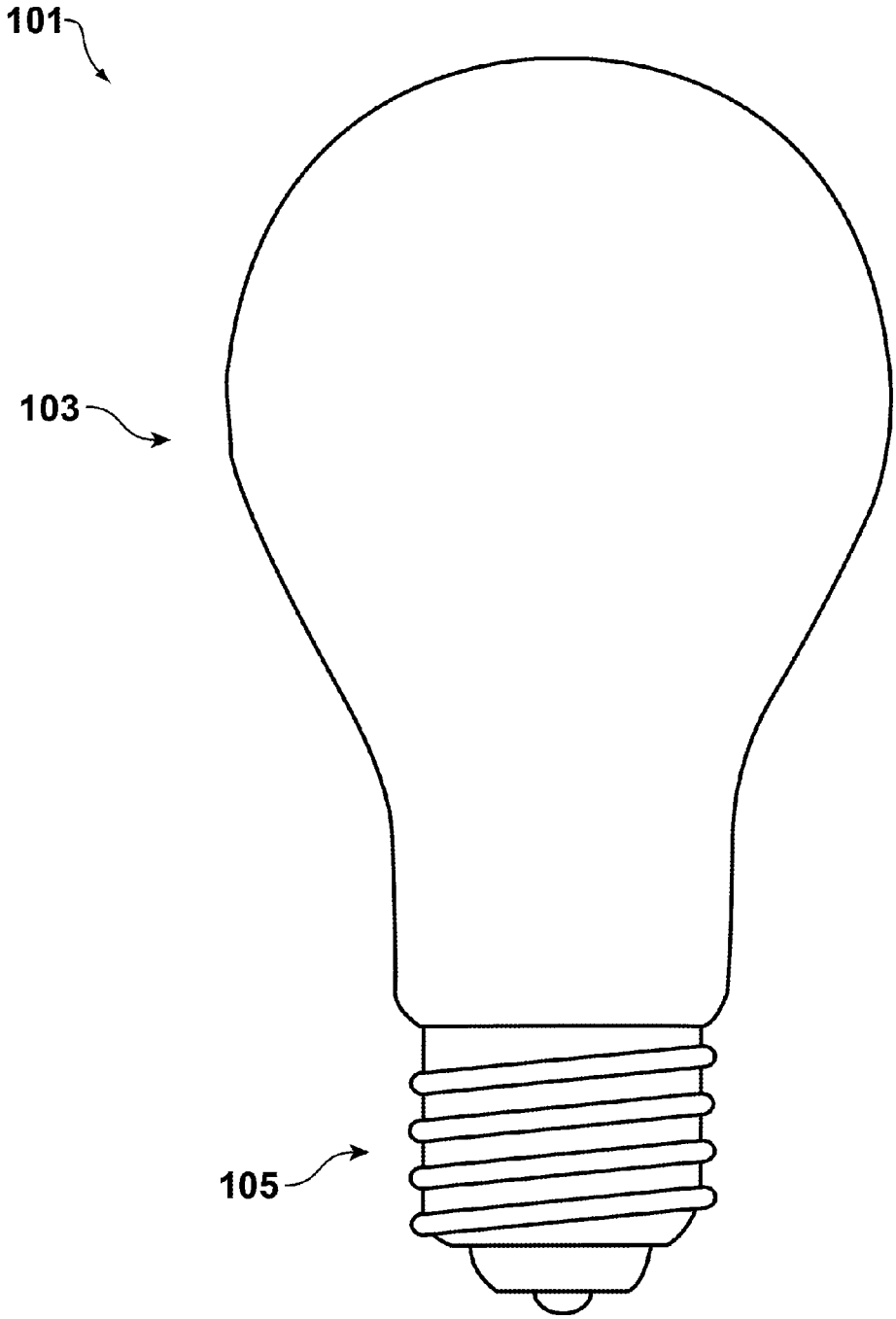
FIG. 1 is an illustration of an illumination device in accordance with the teachings herein.
Figure 2:
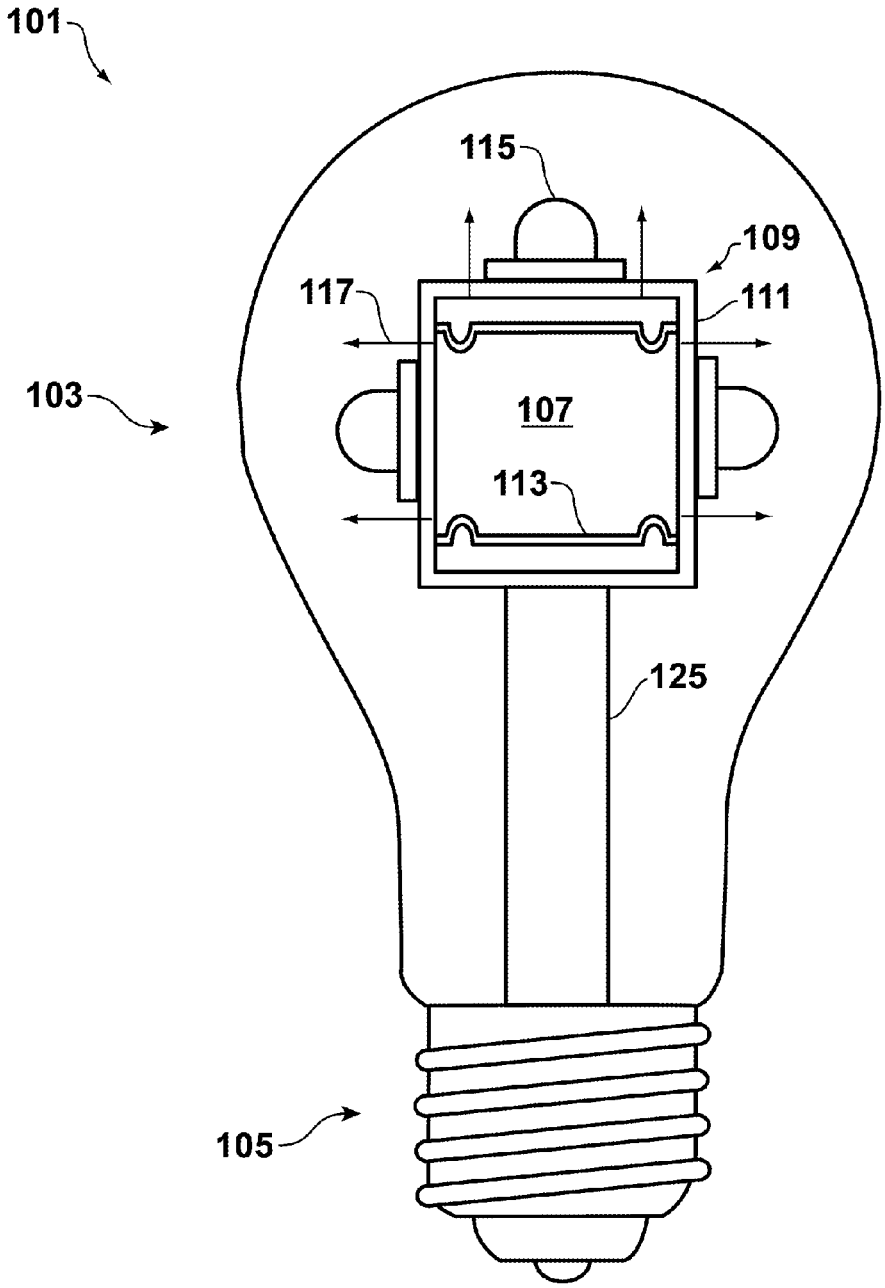
FIG. 2 is an illustration of an illumination device in accordance with the teachings herein.
Figure 3:
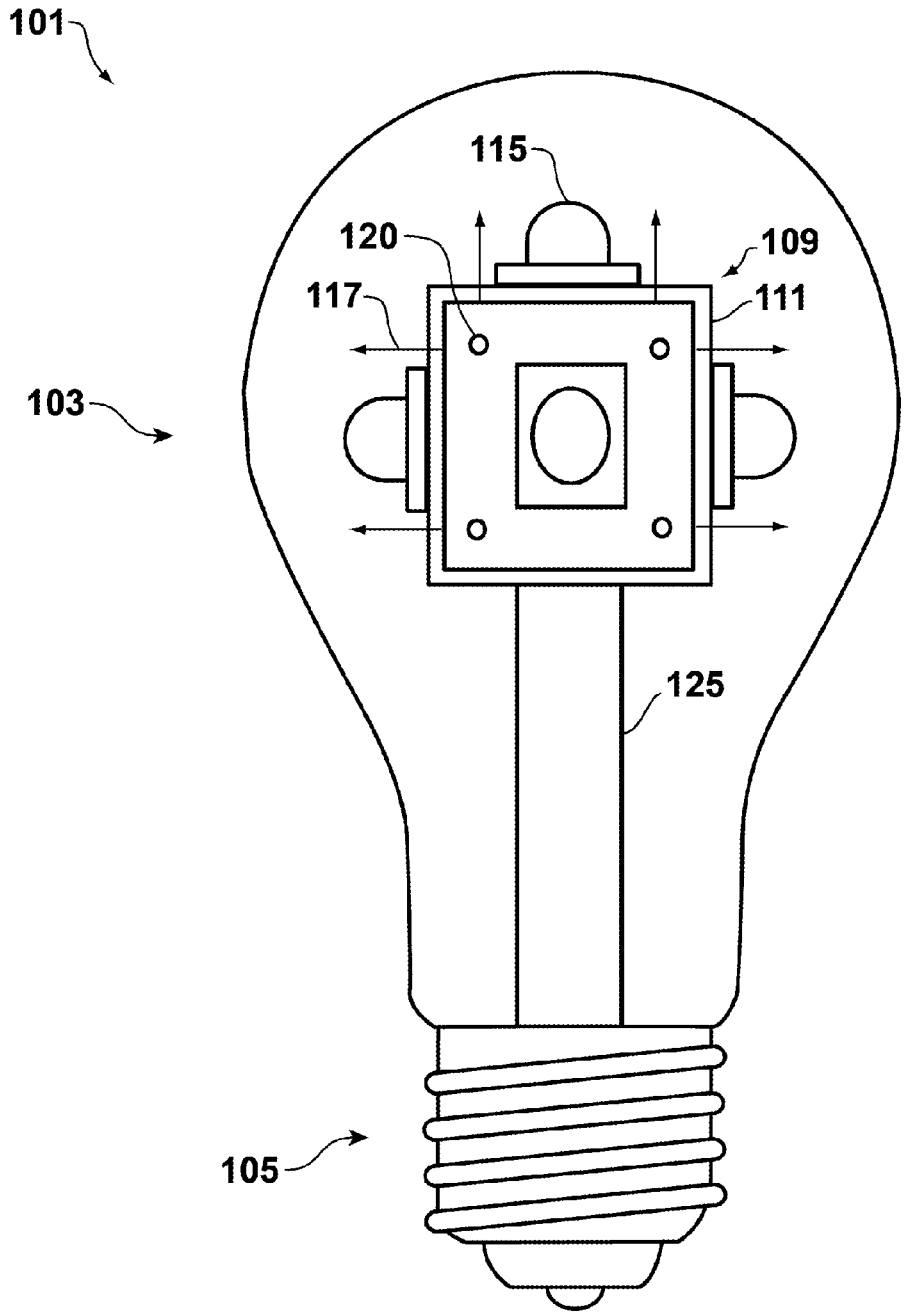
FIG. 3 is an illustration of an illumination device in accordance with the teachings herein.

FIGS. 1 to 3 depict a first particular, non-limiting embodiment of an LED-based illumination device in accordance with the teachings herein. As seen therein, the illumination device 101 comprises a light-emitting portion 103 which emits light, and a connector module 105 which connects the illumination device 101 to the electrical outlet of a light fixture. In the particular embodiment depicted, the connector module 105 is a threaded connector module that rotatingly engages a complimentary shaped socket in an electrical outlet (not shown), though it will be appreciated that the illumination devices disclosed herein are not necessarily limited to use in conjunction with such an outlet.

The light emitting portion 101 in this embodiment houses a pedestal 125 (see FIG. 2) upon which is disposed a synthetic jet ejector 109. The synthetic jet ejector 109 comprises a housing 111 which contains a set of diaphragms 113, and upon an exterior surface of which are disposed a plurality of LEDs 115. The set of diaphragms 113 operate to generate a plurality of synthetic jets 117, which are emitted from a plurality of apertures 120 (see FIG. 3) provided in the synthetic jet actuator housing 111, and which transfer heat from the LEDs to the interior of the light emitting portion 103. The apertures 120 may be disposed in a variety of suitable patterns around one or more of the LEDs 115, one particular example of which is depicted in FIG. 3. The heat in the interior of the light emitting portion 103 may then be transferred to the external environment through thermal transfer across the surface of the light emitting portion 103 or by other suitable means.

Figure 4:
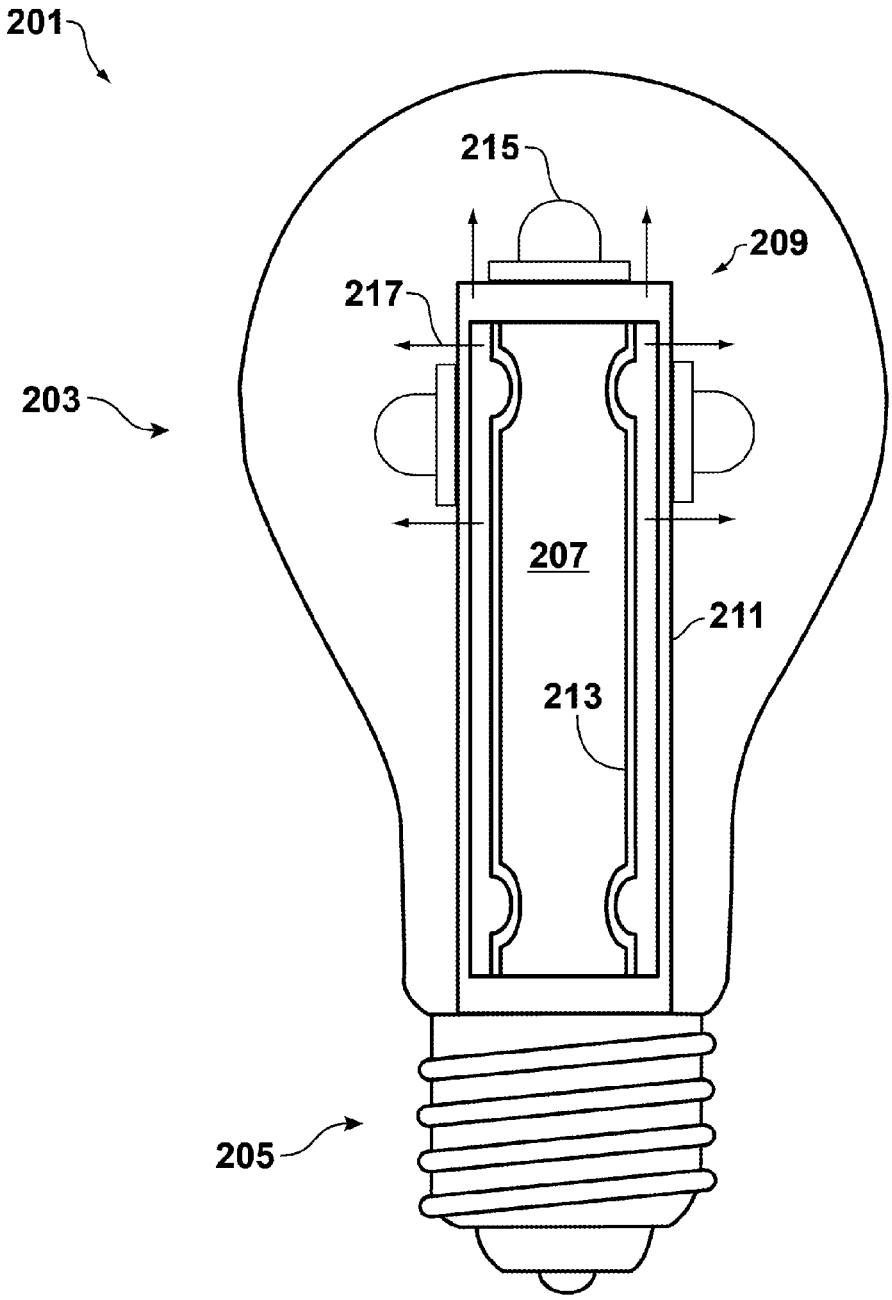
FIG. 4 is an illustration of an illumination device in accordance with the teachings herein.

FIG. 4 depicts another particular, non-limiting embodiment of an LED-based illumination device in accordance with the teachings herein is disclosed. As seen therein, the illumination device 201 comprises a light-emitting portion 203 which emits light, and a connector module 205 which connects the illumination device 201 to the electrical outlet of a light fixture. In the particular embodiment depicted, the connector module 205 is a threaded connector module that rotatingly engages a complimentary shaped socket in an electrical outlet (not shown), though it will be appreciated that the illumination devices disclosed herein are not necessarily limited to use in conjunction with such an outlet.

The light emitting portion 201 in this embodiment contains a synthetic jet actuator housing 211 which contains a set of diaphragms 213, and upon an exterior surface of which are disposed a plurality of LEDs 215. The set of diaphragms 213 operate to generate a plurality of synthetic jets 217, which are emitted from a plurality of apertures (not shown) provided in the synthetic jet actuator housing 211, and which transfer heat from the LEDs 215 to the interior of the light emitting portion 203. The apertures may be disposed in a variety of suitable patterns around one or more of the LEDs 215, one particular example of which is depicted in FIG. 4. The heat in the interior of the light emitting portion 203 may then be transferred to the external environment through thermal conduction, through the provision of apertures or vents in the light emitting portion 203, or by other suitable means.

The embodiment of FIG. 4 differs from the embodiment of FIGS. 1-3 in that the pedestal 125 of the embodiment of FIGS. 1-3 has essentially been replaced with the synthetic jet actuator housing 211. Such a construction allows for the use of larger diaphragms 213 which, in some applications and embodiments, may allow the synthetic jet actuator 207 to dissipate a larger amount of heat than a comparable device with smaller diaphragms 213.

Figure 5:
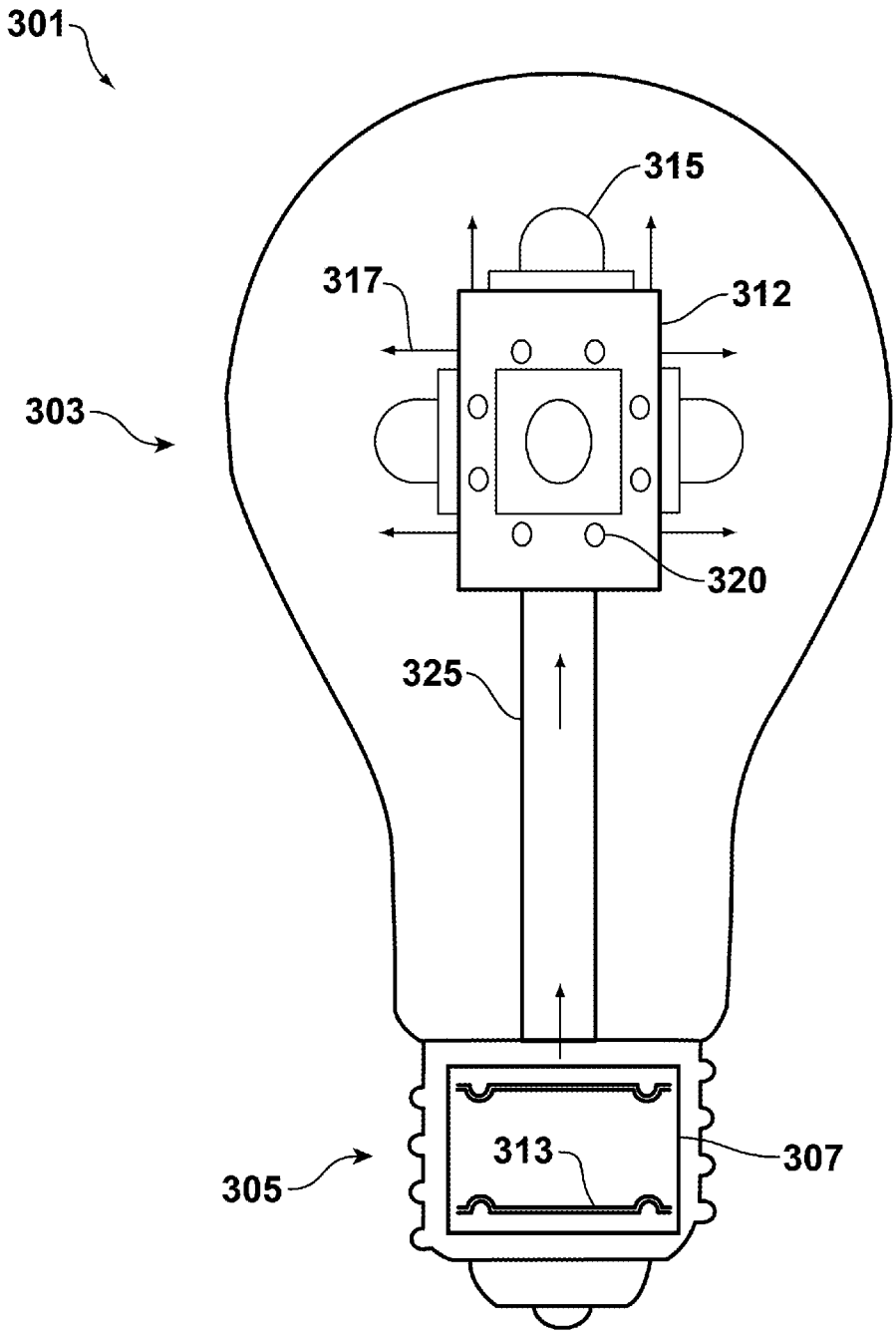
FIG. 5 is an illustration of an illumination device in accordance with the teachings herein.

FIG. 5 depicts another particular, non-limiting embodiment of an LED-based illumination device in accordance with the teachings herein. As seen therein, the illumination device 301 comprises a light-emitting portion 303 which emits light, and a connector module 305 which connects the illumination device 301 to the electrical outlet of a light fixture. In the particular embodiment depicted, the connector module 305 is a threaded connector module that rotatingly engages a complimentary shaped socket in an electrical outlet (not shown), though it will be appreciated that the illumination devices disclosed herein are not necessarily limited to use in conjunction with such an outlet.

The connector module 305 in this embodiment contains a synthetic jet actuator 307 which is equipped with a set of diaphragms 313. The synthetic jet actuator 307 is in fluidic communication with a pedestal 325 which is equipped on one end with a plenum 312. The plenum 312 is equipped with a plurality of apertures 320, and has a plurality of LEDs 315 disposed on an exterior surface thereof. The set of diaphragms 313 operate to generate a plurality of synthetic jets 317, which are emitted from a plurality of apertures 320 provided in the plenum 312, and which transfer heat from the LEDs 315 to the interior of the light emitting portion 303. The apertures 320 may be disposed in a variety of suitable patterns around one or more of the LEDs 315. The heat in the interior of the light emitting portion 303 may then be transferred to the external environment through thermal conduction, through the provision of apertures or vents in the light emitting portion 303, or by other suitable means.

The embodiment of FIG. 5 differs from the embodiment of FIGS. 1-3 in that the synthetic jet actuator 307 has been moved from the light emitting portion 303 of the device to the connector module 305. This arrangement is advantageous in some applications in that more of the interior space of the light emitting portion 303 is available for other purposes. It will be appreciated that this embodiment may offer greater flexibility in some applications with respect to the size and dimensions of the plenum 312, and the manner in which the LEDs 315 are disposed thereon.

Figure 6:
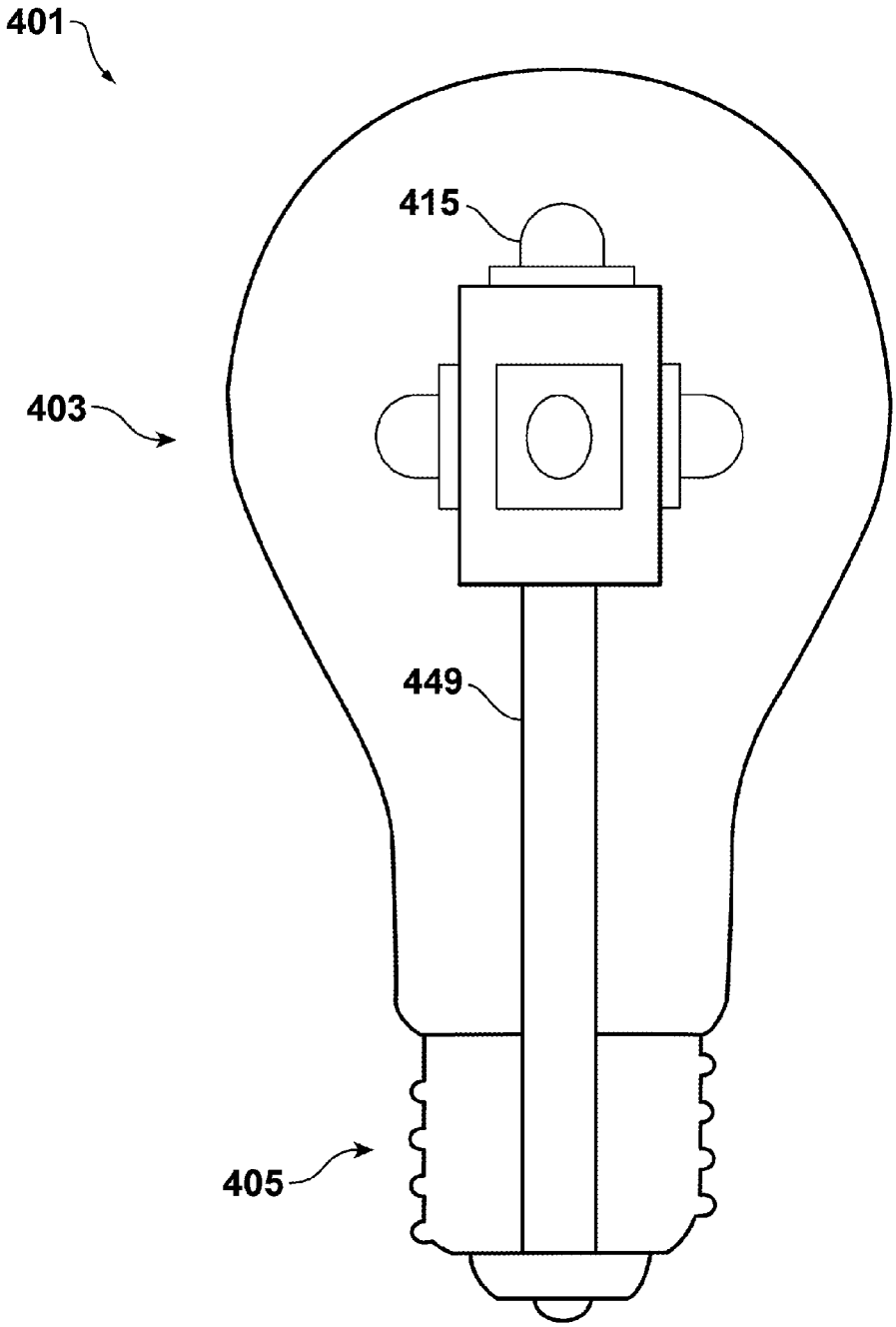
FIG. 6 is an illustration of an illumination device in accordance with the teachings herein.

FIG. 6 depicts another particular, non-limiting embodiment of an LED-based illumination device in accordance with the teachings herein. The illumination device 401 depicted therein comprises a light-emitting portion 403 which emits light, and a connector module 405 which connects the illumination device 401 to the electrical outlet of a light fixture.

This embodiment is similar to the embodiment of FIG. 3, except that the pedestal 125 of that embodiment has been replaced with a heat pipe 449. The heat pipe 449 is preferably in thermal communication with the connector module 405. A plurality of LEDs 415 are disposed on one end of the heat pipe 449. In some variations of this embodiment, the LEDs 415 may be mounted on a portion of the heat pipe 449 or on a thermally conductive substrate which is in thermal contact with the heat pipe 449. In some instances, this thermally conductive substrate may be the housing of a synthetic jet ejector or plenum thereof as in FIGS. 2 or 5, though variations of this embodiment are also contemplated which are devoid of a synthetic jet ejector.

Figure 7:
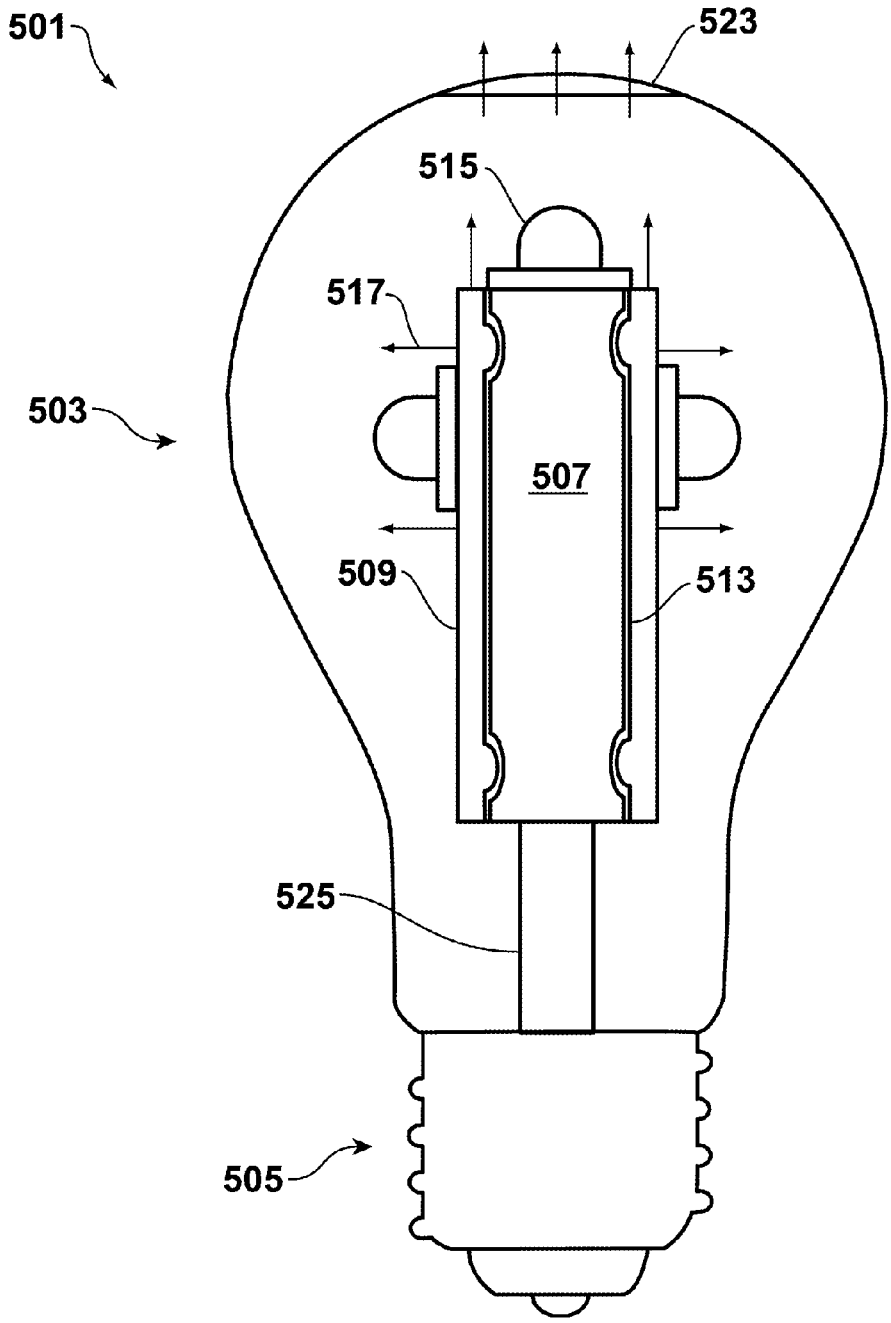
FIG. 7 is an illustration of an illumination device in accordance with the teachings herein.

FIG. 7 depicts another particular, non-limiting embodiment of an LED-based illumination device in accordance with the teachings herein. The illumination device 501 depicted therein comprises a light-emitting portion 503 which emits light, and a connector module 505 which connects the illumination device 501 to the electrical outlet of a light fixture.

The illumination device 501 in this embodiment is a hybrid of the embodiments depicted in FIGS. 2 and 4. In particular, this embodiment utilizes a vertical arrangement of the diaphragms 513 in the synthetic jet ejector 509, but also utilizes a pedestal 525. In some variations, the pedestal 525 may be replaced with, or may include, a heat pipe.

The illumination device 501 in this embodiment is also equipped with a vent 523 which allows the atmosphere inside of the light emitting portion 503 to be in fluidic communication with the external atmosphere. In some variations of this embodiment, the synthetic jet ejector 509 may be adapted to emit synthetic jets from apertures in the vent 523, either solely or in addition to emitting synthetic jets 517 from the actuator housing 511.

Figure 8:
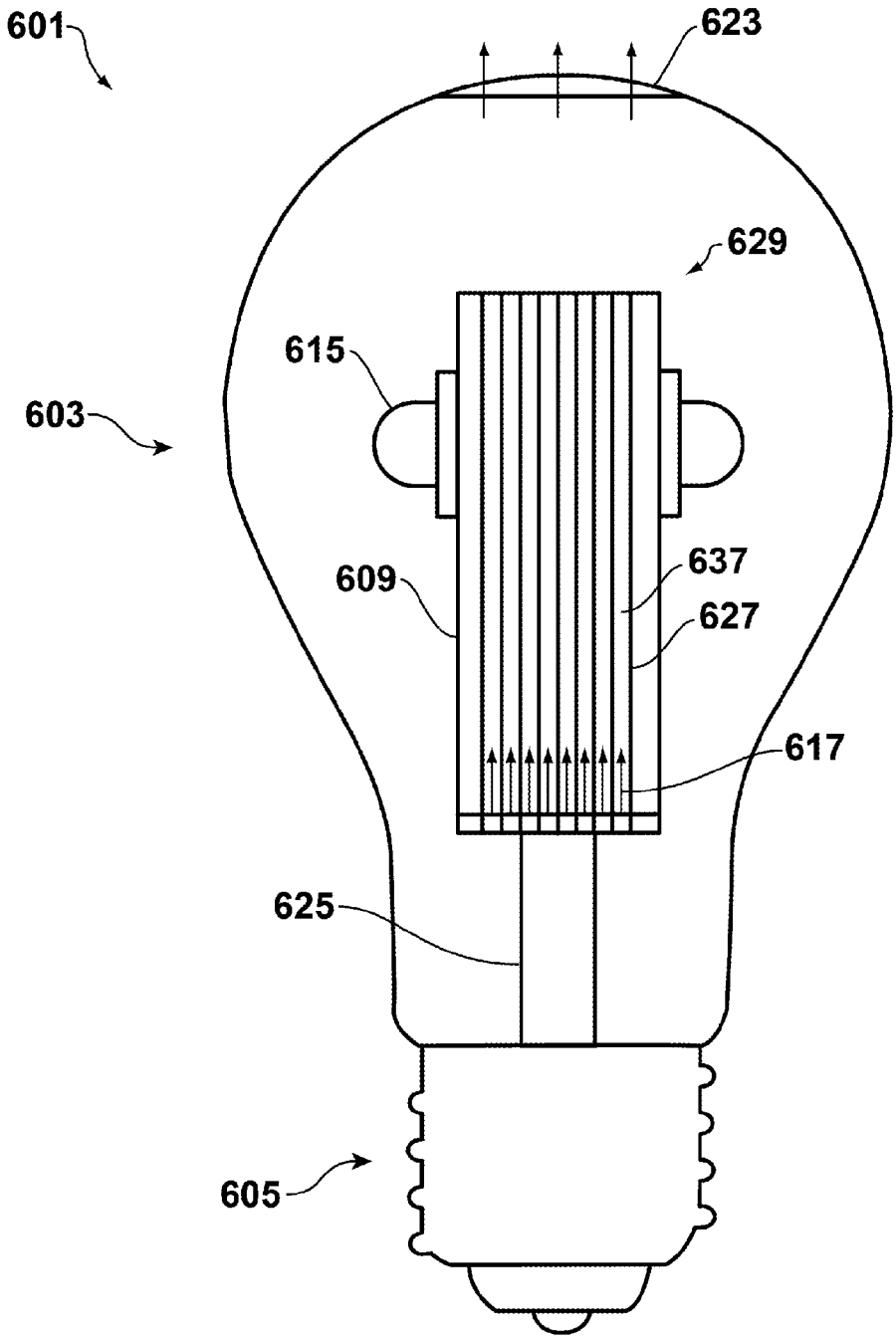
FIG. 8 is an illustration of an illumination device in accordance with the teachings herein.

FIG. 8 depicts another particular, non-limiting embodiment of an LED-based illumination device in accordance with the teachings herein. The illumination device 601 depicted therein comprises a light-emitting portion 603 which emits light, and a connector module 605 which connects the illumination device 601 to the electrical outlet of a light fixture.

The illumination device 601 in this embodiment is similar in many respects to the illumination device 501 of FIG. 7, but is equipped on an external surface thereof with a series of heat fins 627. The synthetic jet ejector 609 in this embodiment is adapted to direct a synthetic jet 617 into each channel 637 defined by an opposing pair of heat fins 627. The illumination device 601 in this embodiment is also equipped with a vent 623 which brings the atmosphere inside of the light emitting portion 603 into fluidic communication with the external atmosphere. In some variations of this embodiment, the synthetic jet ejector 609 may be adapted to emit synthetic jets from apertures in the vent 623 in addition to the synthetic jets 617 which are emitted from the synthetic jet ejector 609.

Figure 9:
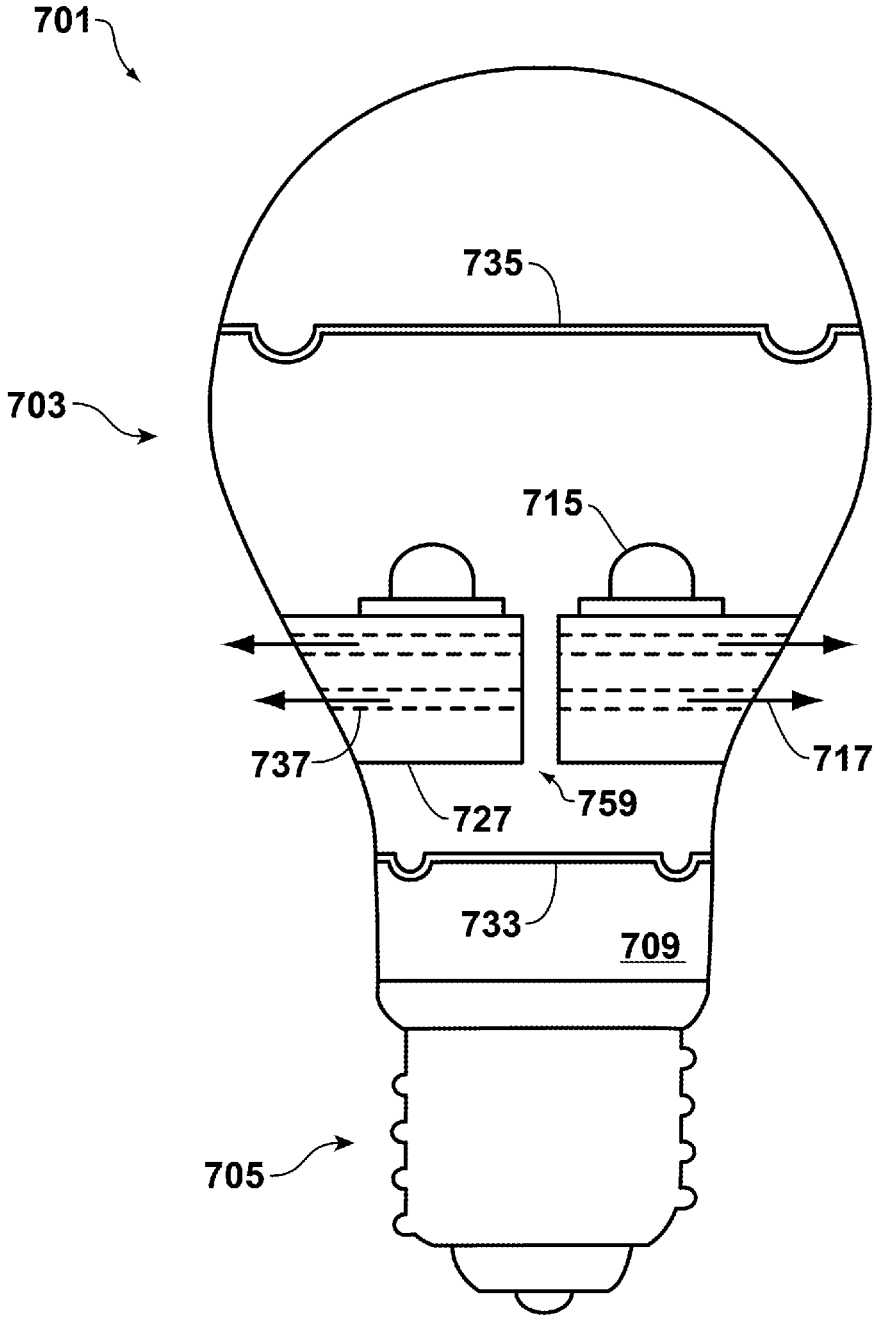
FIG. 9 is an illustration of an illumination device in accordance with the teachings herein.

FIG. 9 depicts another particular, non-limiting embodiment of an LED-based illumination device in accordance with the teachings herein. The illumination device 701 depicted therein comprises a light-emitting portion 703 which emits light, and a connector module 705 which connects the illumination device 701 to the electrical outlet of a light fixture.

The light emitting portion 703 in this embodiment contains an active diaphragm 733 and a passive diaphragm 735 which are in fluidic communication with each other. A heat sink 759 comprising at least one heat fin 727 is disposed between the active diaphragm 733 and the passive diaphragm 735 and has a plurality of LEDs 715 disposed thereon. Each heat fin 727 has at least one channel 737 defined therein which is in fluidic communication with the environment external to the light emitting portion.

In operation, the active diaphragm 733 vibrates to produce a plurality of synthetic jets 717 in the air passing through the channels 737 and into the external environment. Hence, as the heat fins 727 absorb heat from the LEDs 715 mounted on the heat sink 759, this operation ensures that the heat is efficiently transferred to the external environment through the turbulent flow created by the synthetic jets 717. During operation, the larger passive diaphragm 735 basically serves as a counterweight to the active diaphragm 733, which allows the synthetic jet actuator 709 to provide sufficient heat flux while operating outside of the audible range and producing fewer vibrations.

The passive diaphragm 735 preferably has the same mass as the active diaphragm 733, although the dimensions of the two diaphragms may be the same or different. The passive diaphragm 735 may also be of the same or different construction as the active diaphragm 733. In some implementations of the embodiment, the passive diaphragm 735 may comprise a transparent or translucent material.

Figure 10:
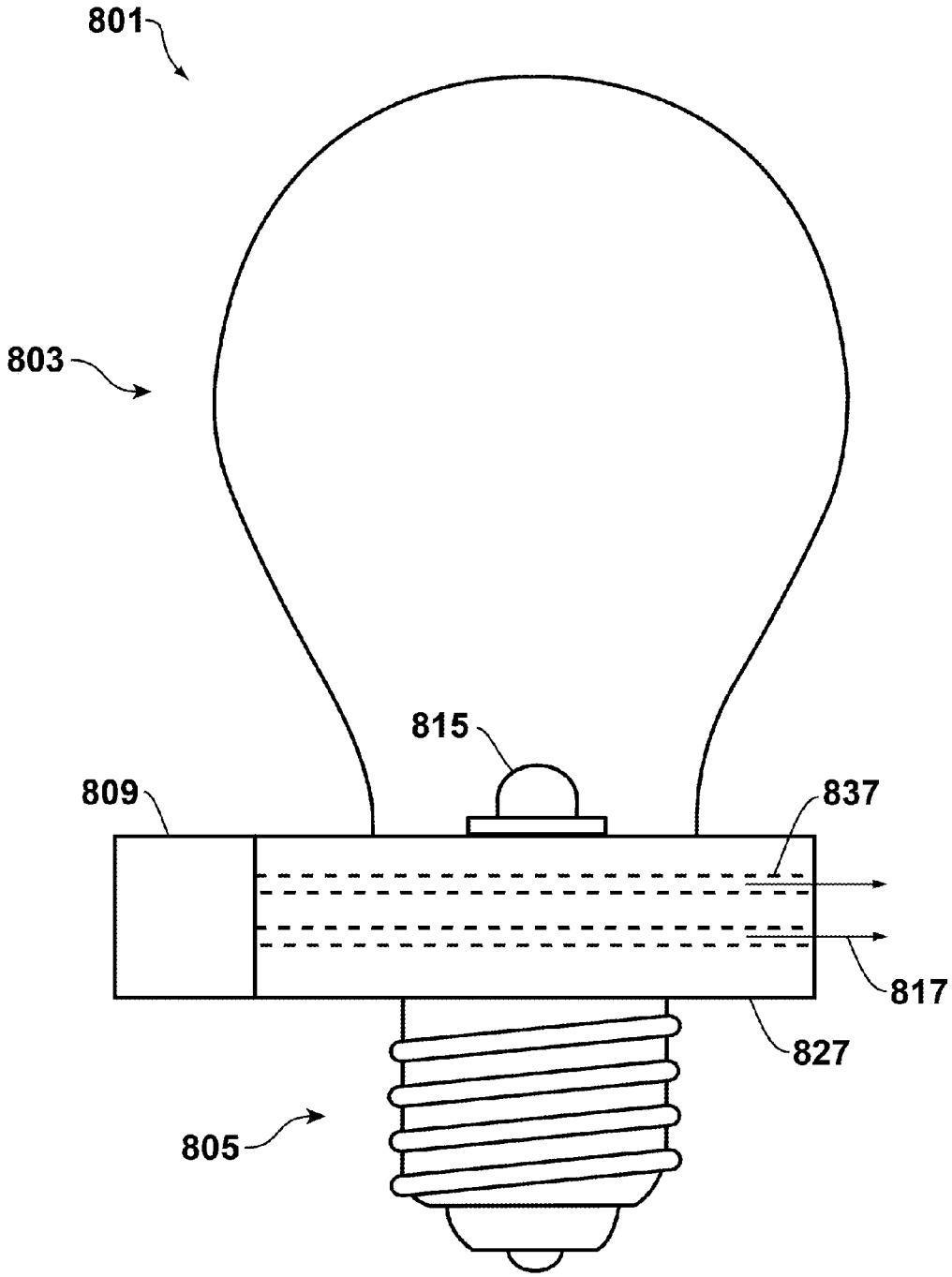
FIG. 10 is an illustration of an illumination device in accordance with the teachings herein.

FIG. 10 depicts another particular, non-limiting embodiment of an LED-based illumination device in accordance with the teachings herein. The illumination device 801 depicted therein comprises a light-emitting portion 803 which emits light, and a connector module 805 which connects the illumination device 801 to the electrical outlet of a light fixture.

The illumination device 801 in this embodiment is equipped with a combination synthetic jet ejector/heat sink 829 which contains both a synthetic jet ejector 809 and a heat sink 827. These two components may be combined in a variety of ways, and each of these components, or the combination thereof, may have a variety of shapes or sizes. The two components may also comprise a variety of materials, though the heat sink 827 preferably comprises a thermally conductive material such as a metal (such as, for example, copper, aluminum, tin, steel, or various combinations or alloys thereof) or a thermally conductive loaded polymer. In the particular embodiment depicted, however, the heat sink 827 extends from one side of the synthetic jet ejector 809 and is adapted to direct synthetic jets 817 through channels 837 defined in the heat sink 827. Since the LED 815 is mounted on top of the heat sink 827 and is in thermal communication therewith, this arrangement transfers heat from the LED 815 to the atmosphere external to the illumination device 801.

In the embodiment depicted in FIG. 10, the light emitting portion 803 is preferably mounted on top of the heat sink 827 and may be open to the external atmosphere or may be vacuum sealed. Appropriate channels or conduits may be provided in the heat sink to accommodate any wires or circuitry associated with the LED 815. In some variations of this embodiment, however, the combination synthetic jet ejector/heat sink 829, the heat sink 827, or the synthetic jet ejector 809 may be disposed on an external surface of the illumination device 801. In such embodiments, if the heat sink 827 is disposed on an exterior surface of the illumination device 801, the LED 815 may be in thermal contact with the heat sink 827 through one or more heat pipes or other thermally conductive elements.

Figure 11:
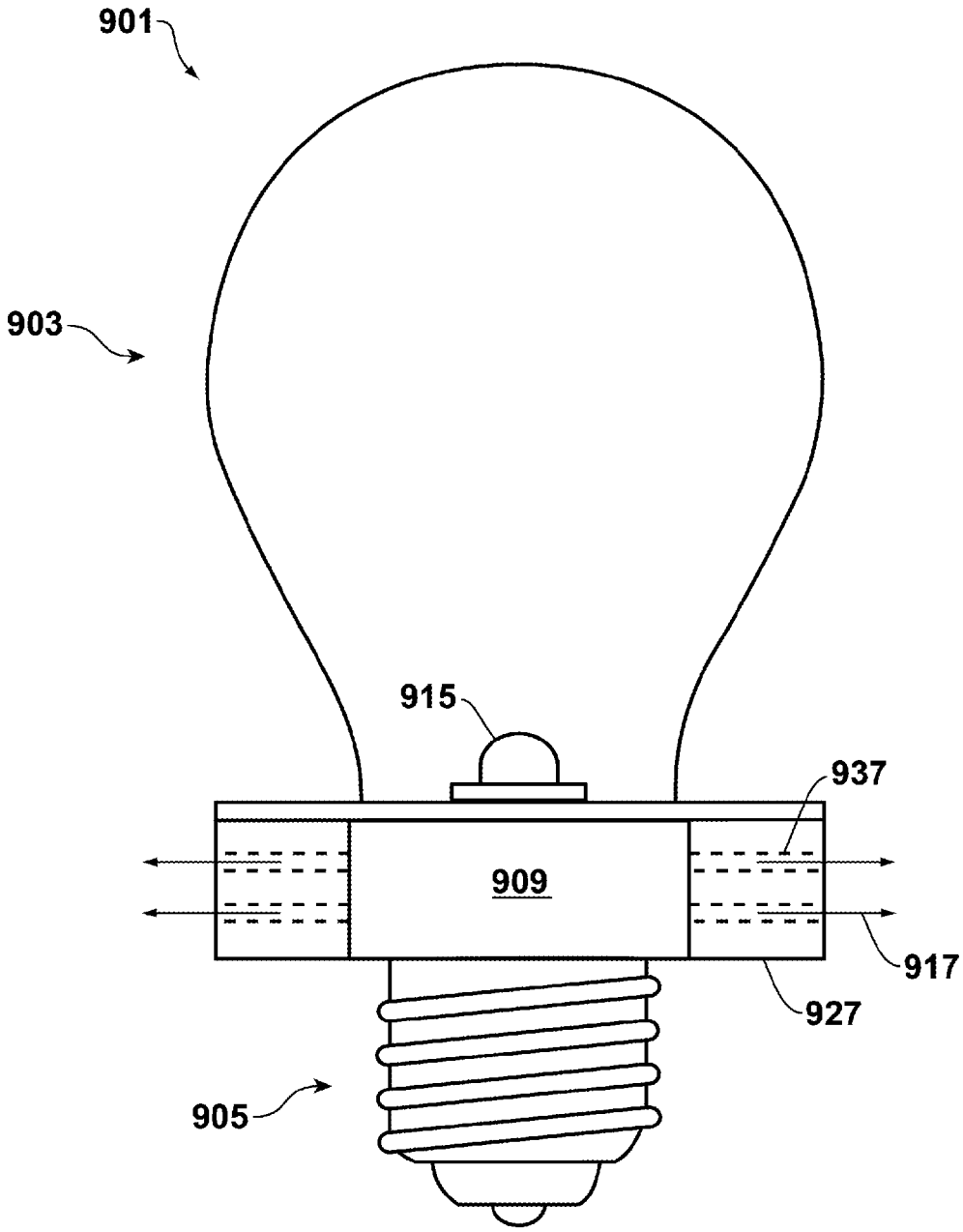
FIG. 11 is an illustration of an illumination device in accordance with the teachings herein.

FIG. 11 depicts another particular, non-limiting embodiment of an LED-based illumination device in accordance with the teachings herein. The illumination device 901 depicted therein comprises a light-emitting portion 903 which emits light, and a connector module 905 which connects the illumination device 901 to the electrical outlet of a light fixture.

The illumination device 901 of this embodiment is similar in most respects to the illumination device 801 of FIG. 10 and hence is equipped with a combination synthetic jet ejector/heat sink 909 which contains both a synthetic jet ejector 909 and a heat sink 927. However, the illumination device 901 in this embodiment differs from the illumination device 801 of FIG. 10 in that the synthetic jet ejector 909 is centrally located. In some implementations, this type of embodiment may facilitate integration of the circuitry of the synthetic jet ejector 909 with the circuitry used to power the LED 915.

Figure 12:
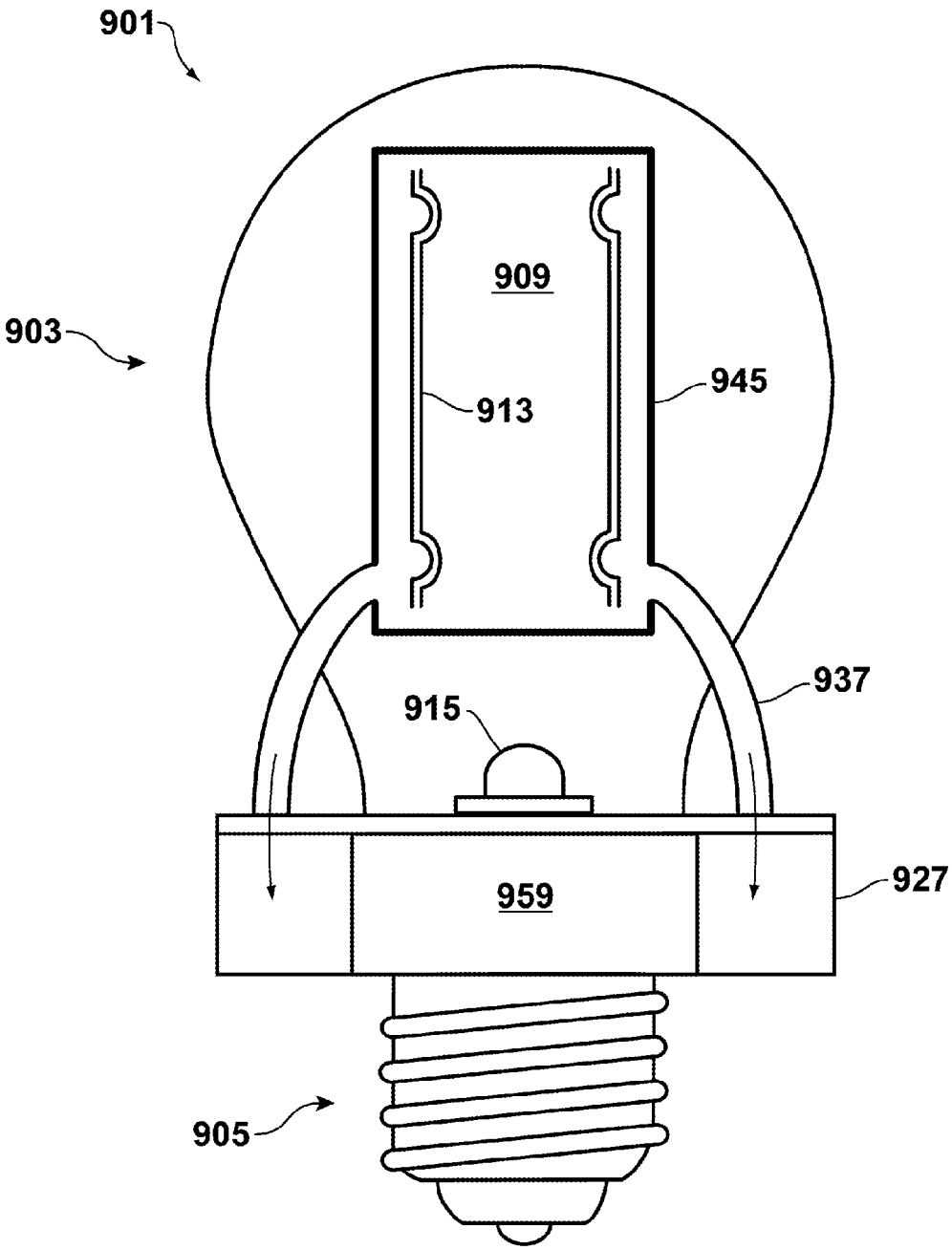
FIG. 12 is an illustration of an illumination device in accordance with the teachings herein.

FIG. 12 depicts a further particular, non-limiting embodiment of an LED-based illumination device in accordance with the teachings herein. The illumination device 1001 depicted therein comprises a light-emitting portion 1003 which emits light, and a connector module 1005 which connects the illumination device 1001 to the electrical outlet of a light fixture.

In this embodiment, a heat sink 1059 is disposed about the exterior of the light emitting portion 1003 and the synthetic jet ejector 1009 is disposed within the light emitting portion 1003. However, the synthetic jet ejector 1009 is in fluidic communication with the heat sink 1059 by way of one or more channels 1037. In the particular embodiment depicted, these channels 1037 extend from the interior of the light emitting portion to the exterior of the light emitting portion 1003, and are adapted to direct one or more synthetic jets across the surfaces of the heat sink 1059 or the heat fins 1027 thereof.

Figure 13:
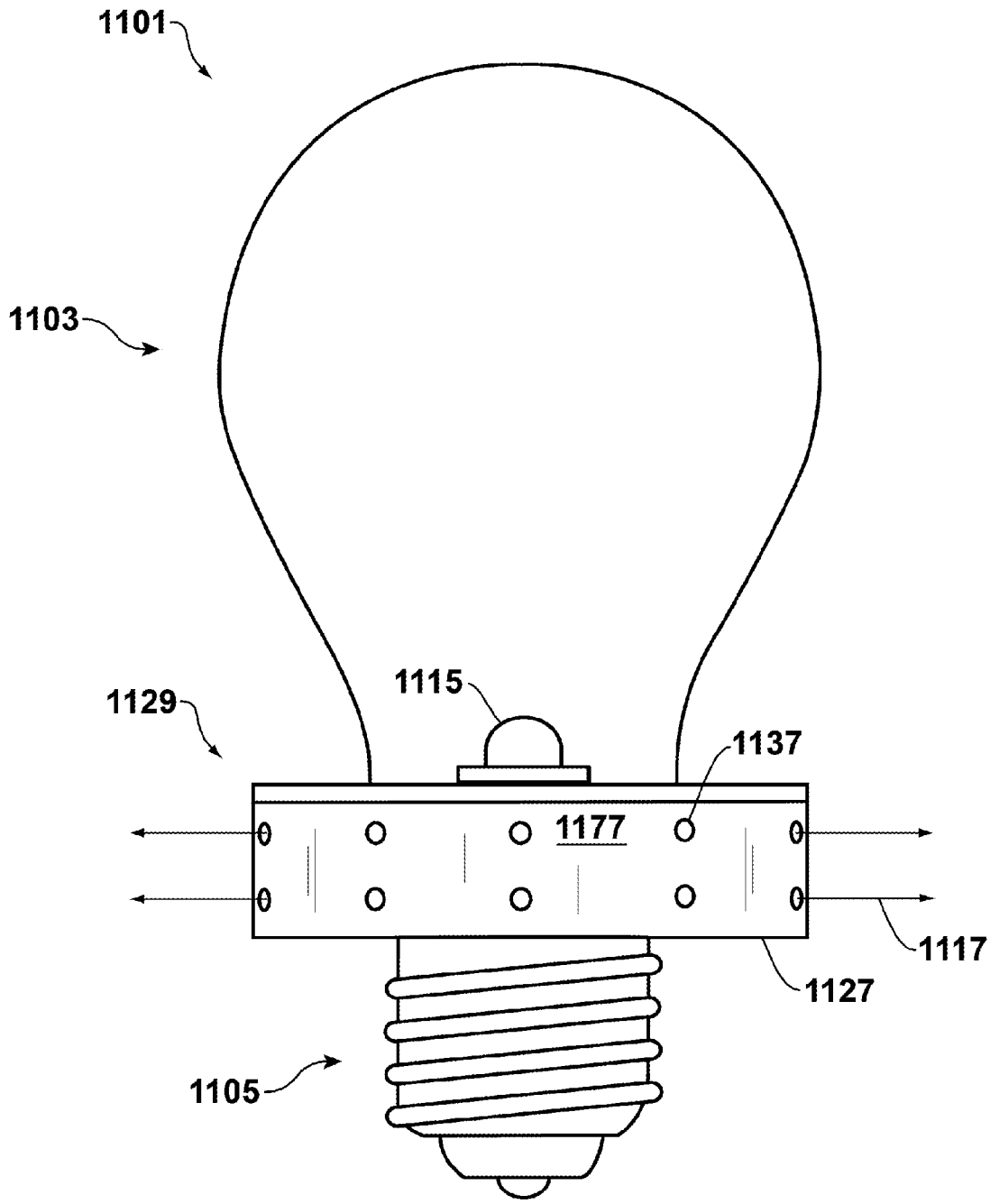
FIG. 13 is an illustration of an illumination device in accordance with the teachings herein.

FIG. 13 depicts another particular, non-limiting embodiment of an LED-based illumination device in accordance with the teachings herein. The illumination device 1101 depicted therein comprises a light-emitting portion 1103 which emits light, and a connector module 1105 which connects the illumination device 1101 to the electrical outlet of a light fixture.

The illumination device 1101 of this embodiment is similar in most respects to the illumination device 901 of FIG. 11 and hence is equipped with a combination synthetic jet ejector/heat sink 1129 (shown in greater detail in FIG. 14) which contains both a synthetic jet actuator 1107 and a heat sink 1159. However, the illumination device 1101 in this embodiment differs from the illumination device 901 of FIG. 11 in that the heat sink 1127 is covered with a smooth exterior surface having a plurality of apertures 1123 defined therein (see FIG. 13). These apertures 1123 are in fluidic communication with the synthetic jet actuator 1107 by way of channels 1137 defined in the heat sink 1127 (see FIG. 14). This type of embodiment may be advantageous in applications where the presence of exposed heat fins on the exterior of the illumination device 1101 would be objectionable or undesirable.

Figure 15:
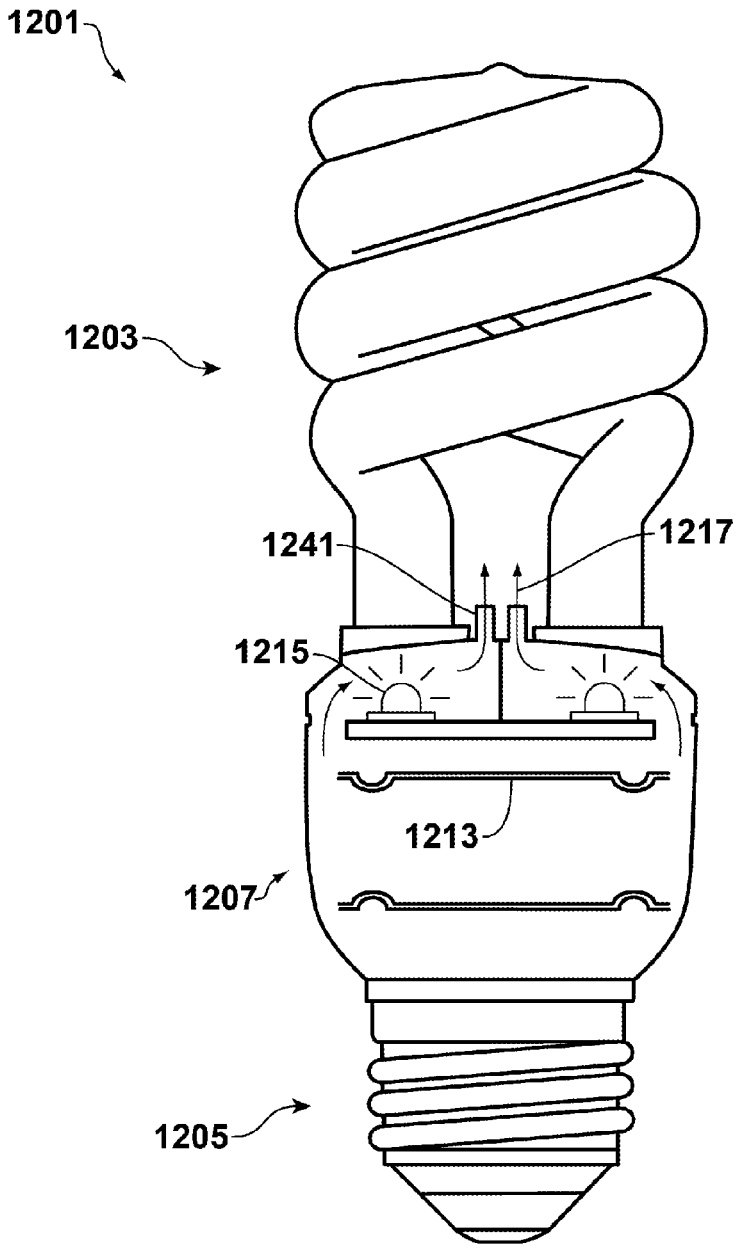
FIG. 15 is an illustration of an illumination device in accordance with the teachings herein.
Figure 16:
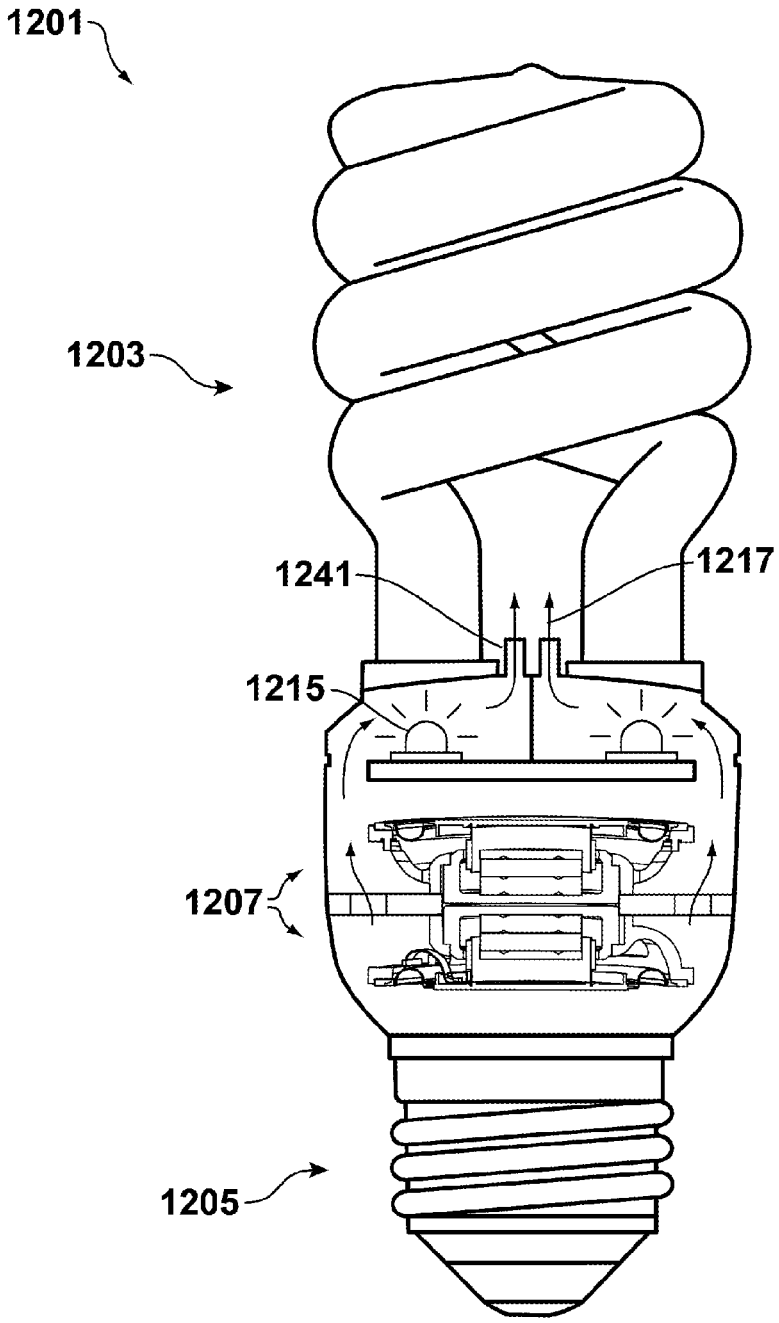
FIG. 16 is an illustration of an illumination device in accordance with the teachings herein.

FIGS. 15 to 16 depict a further particular, non-limiting embodiment of an LED-based illumination device in accordance with the teachings herein. The illumination device 1201 depicted therein comprises a light-emitting portion 1203 which emits light, and a connector module 1205 which connects the illumination device 1201 to the electrical outlet of a light fixture. A synthetic jet actuator 1207 is disposed between the light emitting portion and the connector module 1205.

This embodiment illustrates the application of the principles described herein to a popular type of compact fluorescent light bulb. The synthetic jet actuator 11207 in this embodiment is equipped with a set of nozzles 1241 which are adapted to direct a plurality of synthetic jets 1217 across the surfaces, or into the interior of, the helical coil of the light emitting portion 1203. The nozzles 1241 are in fluidic communication with the interior of the synthetic jet actuator 1207 where the diaphragms 1213 are disposed, and the LEDs 1215 which illuminate the light emitting portion 1203 are disposed in, or adjacent to, this fluidic path.

In operation, the synthetic jet actuator 1207 operates to create a fluidic flow adjacent to, or across the surfaces of, the LEDs 1215, thereby removing heat from the LEDs and rejecting it to the external environment. The hot fluid is ejected as a synthetic jet 1217, and hence is removed a significant distance from the nozzles 1241. The synthetic jets also entrain cool air from the local environment and create a turbulent flow around the surfaces of the helix of the light emitting portion, thus helping to cool this portion of the illumination device 1201 as well. The synthetic jets also draw in cool fluid around the nozzles 1241, which is then drawn into the synthetic jet ejector during the in-flow phase of the diaphragms 1213.

Figure 17:
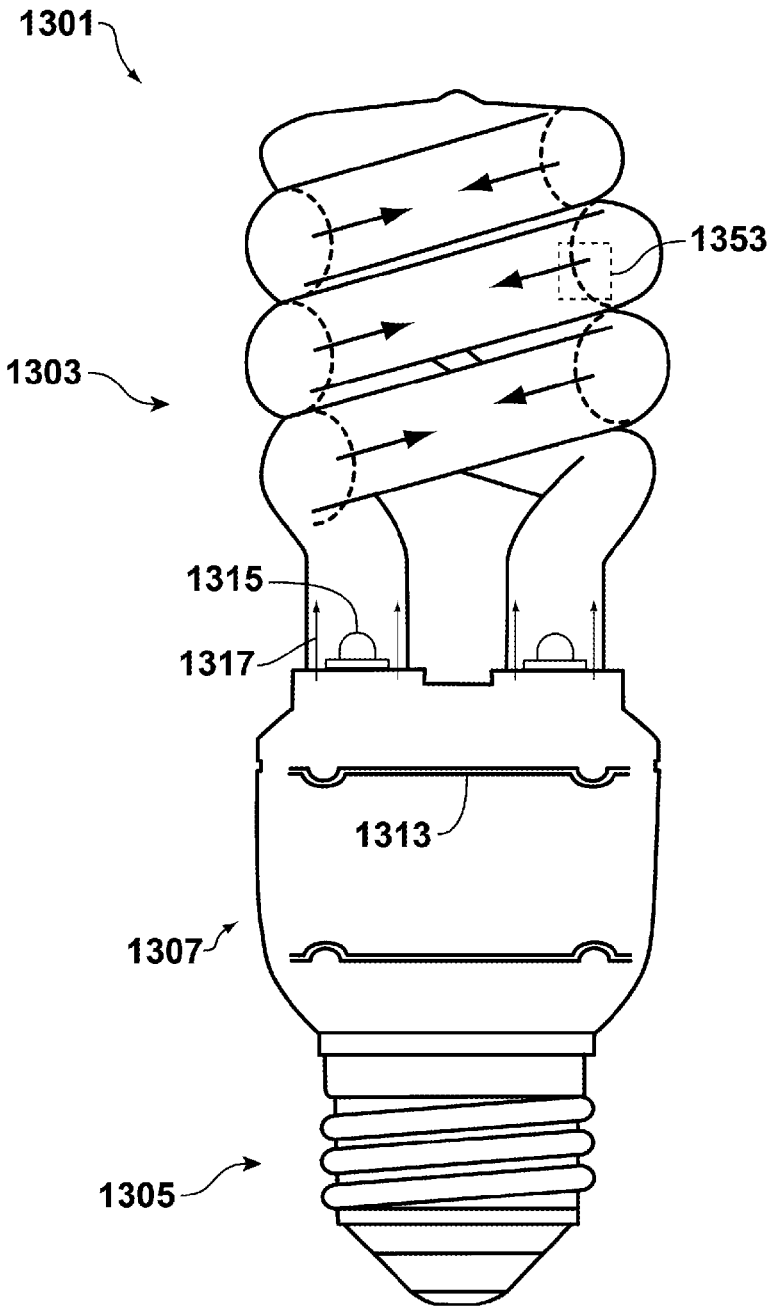
FIG. 17 is an illustration of an illumination device in accordance with the teachings herein.
Figure 18:
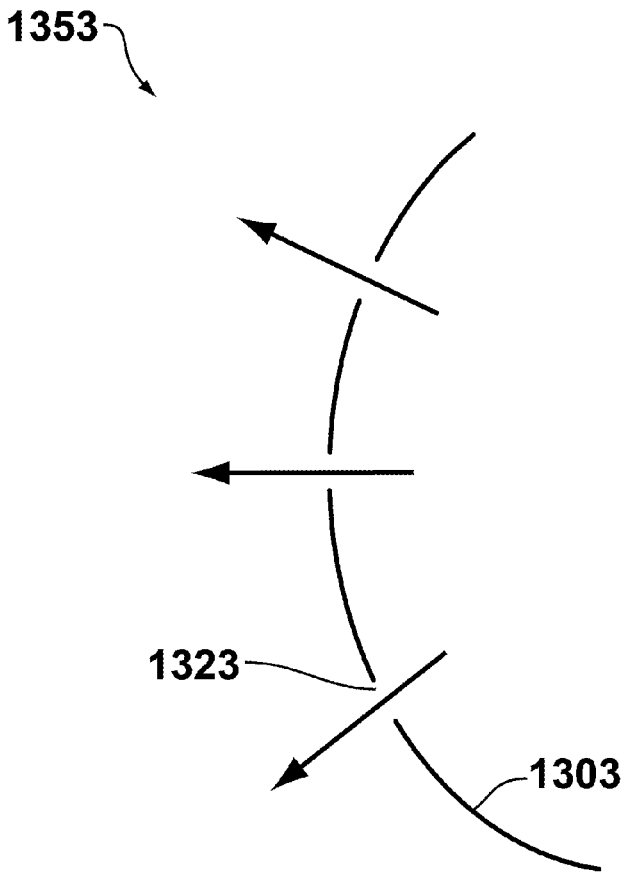
FIG. 18 is an illustration of a portion of the housing structure of the illumination device of FIG. 17.

FIGS. 17 to 18 depict another particular, non-limiting embodiment of an LED-based illumination device in accordance with the teachings herein. The illumination device 1301 depicted therein comprises a light-emitting portion 1303 which emits light, and a connector module 1305 which connects the illumination device 1301 to the electrical outlet of a light fixture. A synthetic jet actuator 1307 is disposed between the light emitting portion and the connector module 1305.

The illumination device of FIGS. 17 to 18 is similar in many respects to the illumination device 1301 of FIGS. 15 to 16. However, in the embodiment of FIGS. 17 to 18, the LEDs 1315 are disposed at entrances to the helical light emitting portion 1303, and the synthetic jet actuator 1307 operates to direct synthetic jets 1317 past the LEDs and into the light emitting portion 1303. As best seen in FIG. 18, region 1353 of the light emitting portion 1303 is equipped with a series of apertures 1323 which vent the fluidic flow to the external atmosphere. The vented flow may be in the form of one or more synthetic jets, but need not be so.

Various modifications may be made to the embodiment depicted in FIGS. 17 to 18. For example, in some variations, a single LED 1315 may be utilized to generate light, and hence only one opening of the helix may be occupied by an LED 1315. In some embodiments, two or more LEDs 1315 may be provided which emit different wavelengths of light, and which provide color mixing for desired optical effects. In some embodiments, the apertures 1323 may be disposed in any desired location on the light emitting portion 1323.

Figure 19:
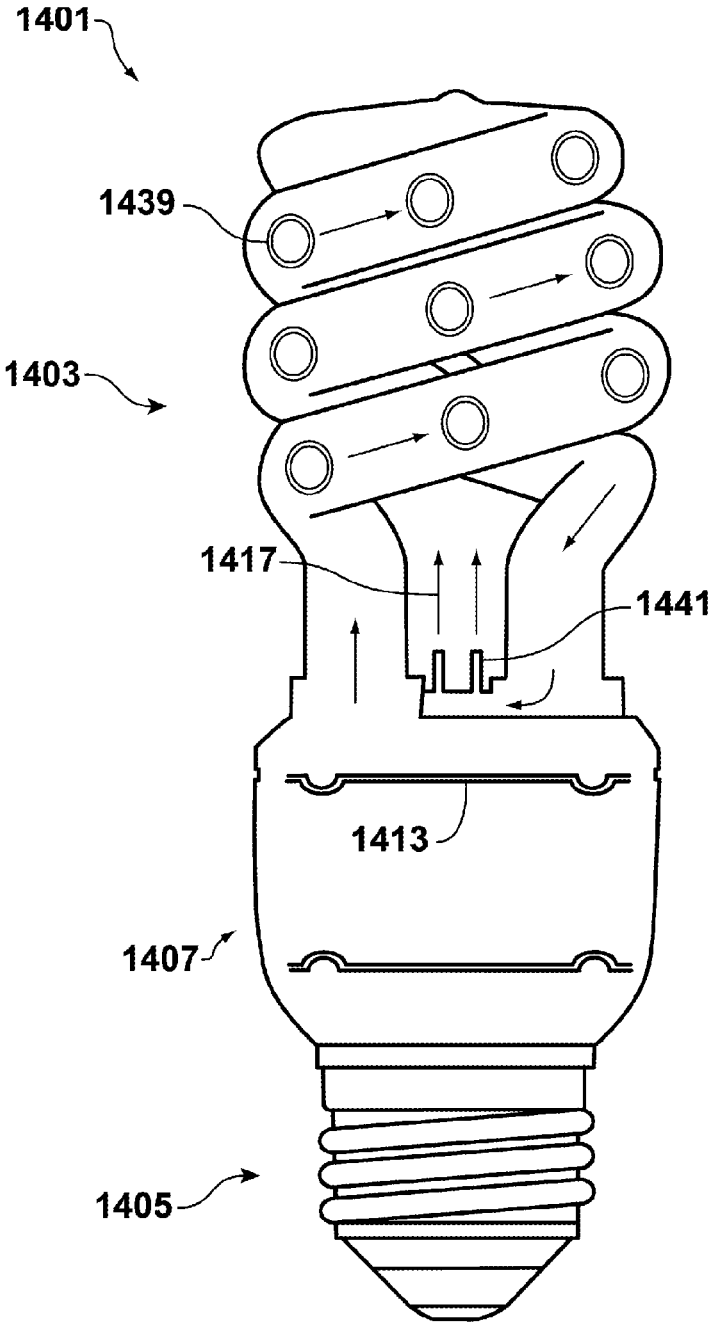
FIG. 19 is an illustration of an illumination device in accordance with the teachings herein.

FIG. 19 depicts another particular, non-limiting embodiment of an LED-based illumination device in accordance with the teachings herein. The illumination device 1401 depicted therein comprises a light-emitting portion 1403 which emits light, and a connector module 1405 which connects the illumination device 1401 to the electrical outlet of a light fixture. A synthetic jet actuator 1407 is disposed between the light emitting portion and the connector module 1405.

The illumination device 1401 of FIG. 19 is similar in most respects to the illumination device of FIG. 15, but differs in the placement of the LEDs 1439. In particular, in the embodiment depicted in FIG. 19, the LEDs 1439 are disposed on the external surface of the helix of the light emitting portion 1403. The synthetic jet actuator 1407 operates to generate a fluidic flow which extends through the coils of the light emitting portion 1403, and exits through nozzles 1441 in the form of synthetic jets 1417. Hence, this embodiment operates to cool the substrate the LED 1439 is disposed on, as well as the light emitting surface of the LED 1439.

In some variations of this embodiment, the helical coils of the light emitting portion 1403 may comprise a suitably thermally conductive material. Such a material may provide for more efficient transfer of heat from the LEDs 1439 to the underlying substrate, where it may be rejected to the external atmosphere by the fluidic flow created by the synthetic jet actuator 1407. In other variations, the LEDs 1439 may be directed inward so that their backsides are exposed to the internal environment, and their light emitting surfaces are directed towards the interior of the helical coil. In these different embodiments, a metallic interconnect may be disposed on the interior or exterior surface of the coils, or may be embedded in the walls of the coils.

Figure 20:
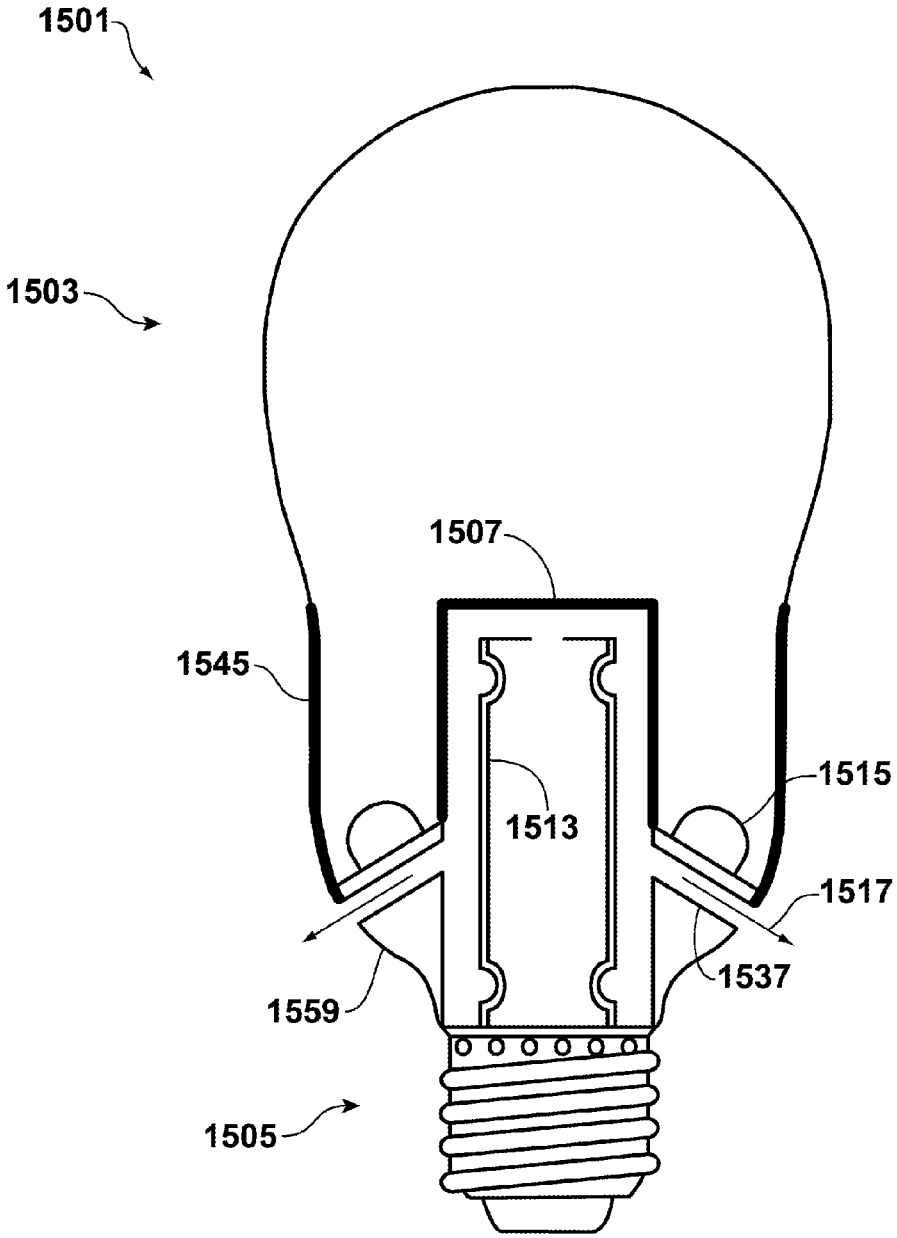
FIG. 20 is an illustration of an illumination device in accordance with the teachings herein.

FIG. 20 depicts another particular, non-limiting embodiment of an LED-based illumination device in accordance with the teachings herein. The illumination device 1501 depicted therein comprises a light-emitting portion 1503 which emits light, and a connector module 1505 which connects the illumination device 1501 to the electrical outlet of a light fixture. A synthetic jet actuator 1507 is disposed between the light emitting portion and the connector module 1505.

In this embodiment, the synthetic jet actuator 1507 is centrally disposed within the light emitting portion 1503, and a plurality of LEDs 1515 are disposed around it. A heat sink 1559 is built into the base of the illumination device 1501, and is equipped with channels 1537 which are in fluidic communication with the synthetic jet actuator 1507. During operation, the synthetic jet actuator 1507 creates a fluidic flow which preferably includes synthetic jets 1517, and which rejects heat from the heat sink 1559 to the external environment.

As indicated in FIG. 20, the surfaces of the illumination device 1501 in the vicinity of the LEDs 1515 may be covered with a suitable reflective material 1545. The amount of the surface area so coated may be determined, for example, by the desired illumination profile of the illumination device 1501. Notably, the design of this illumination device 1501 also allows for the use of relatively large diaphragms 1513 in the synthetic jet actuator 1507, which may be useful in achieving high heat flux from the heat sink 1559 to the external environment.

Figure 21:
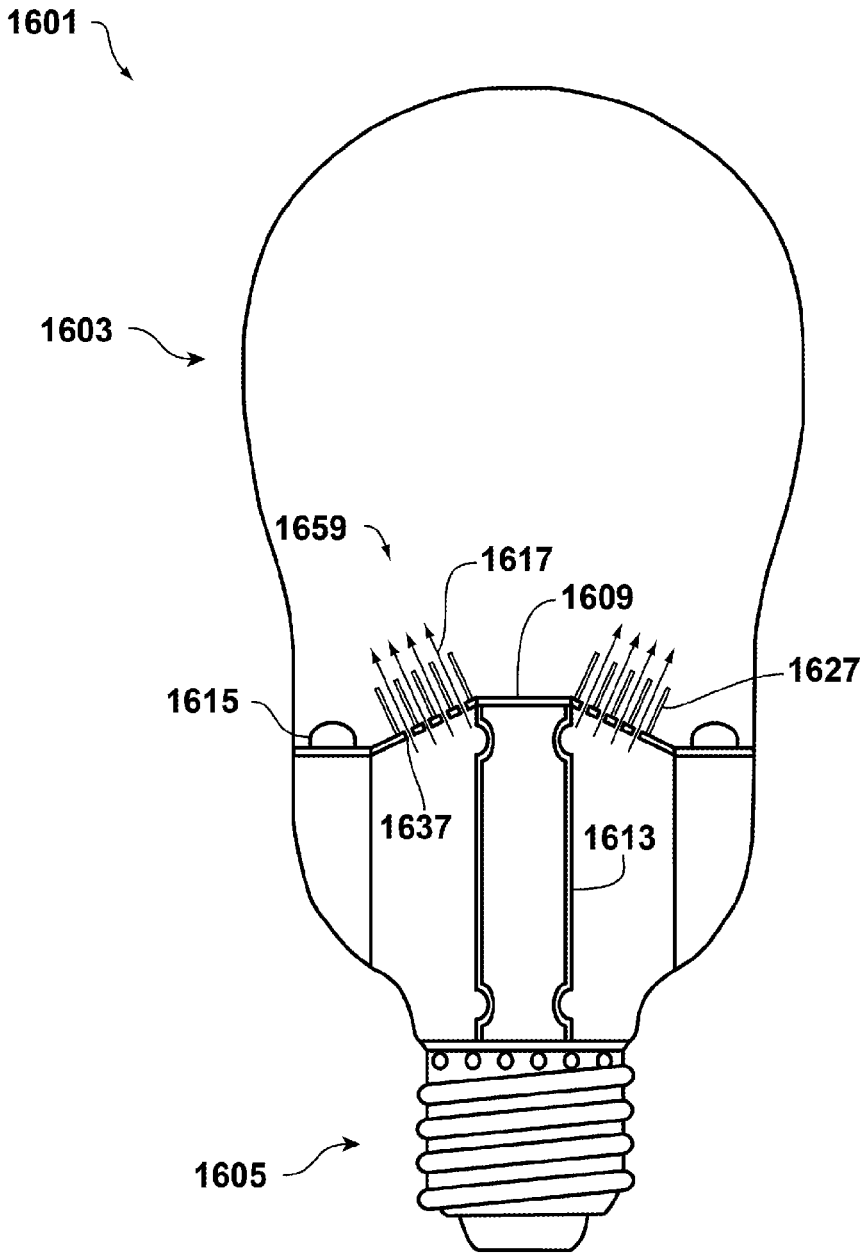
FIG. 21 is an illustration of an illumination device in accordance with the teachings herein.

FIG. 21 depicts another particular, non-limiting embodiment of an LED-based illumination device in accordance with the teachings herein. The illumination device 1601 depicted therein comprises a light-emitting portion 1603 which emits light, and a connector module 1605 which connects the illumination device 1601 to the electrical outlet of a light fixture. A synthetic jet ejector 1609 is disposed between the light emitting portion and the connector module 1605.

One wall of the synthetic jet ejector 1609 is equipped with a heat sink 1659 comprising a plurality of heat fins 1627. The heat fins 1627 are disposed adjacent to an LED 1615 and define a plurality of channels 1637 which are in fluidic communication with the interior of the synthetic jet ejector 1609.

During operation, the heat sink 1659 absorbs heat from the LEDs 1615, and the synthetic jet ejector 1609 generates a plurality of synthetic jets 1617 in the channels 1637 which transfers the heat to the interior environment of the light emitting portion 1603. From there, the heat is rejected to the external environment through thermal transfer. In some implementations, thermal transfer to the external environment may be facilitated by the provision of suitable venting in the light emitting portion 1603 or by other suitable means. As with the previous embodiment, the design of this illumination device 1601 allows for the use of relatively large diaphragms 1613 in the synthetic jet ejector 1609, which may be useful in achieving high heat flux from the heat sink 1659 to the external environment.

Figure 22:
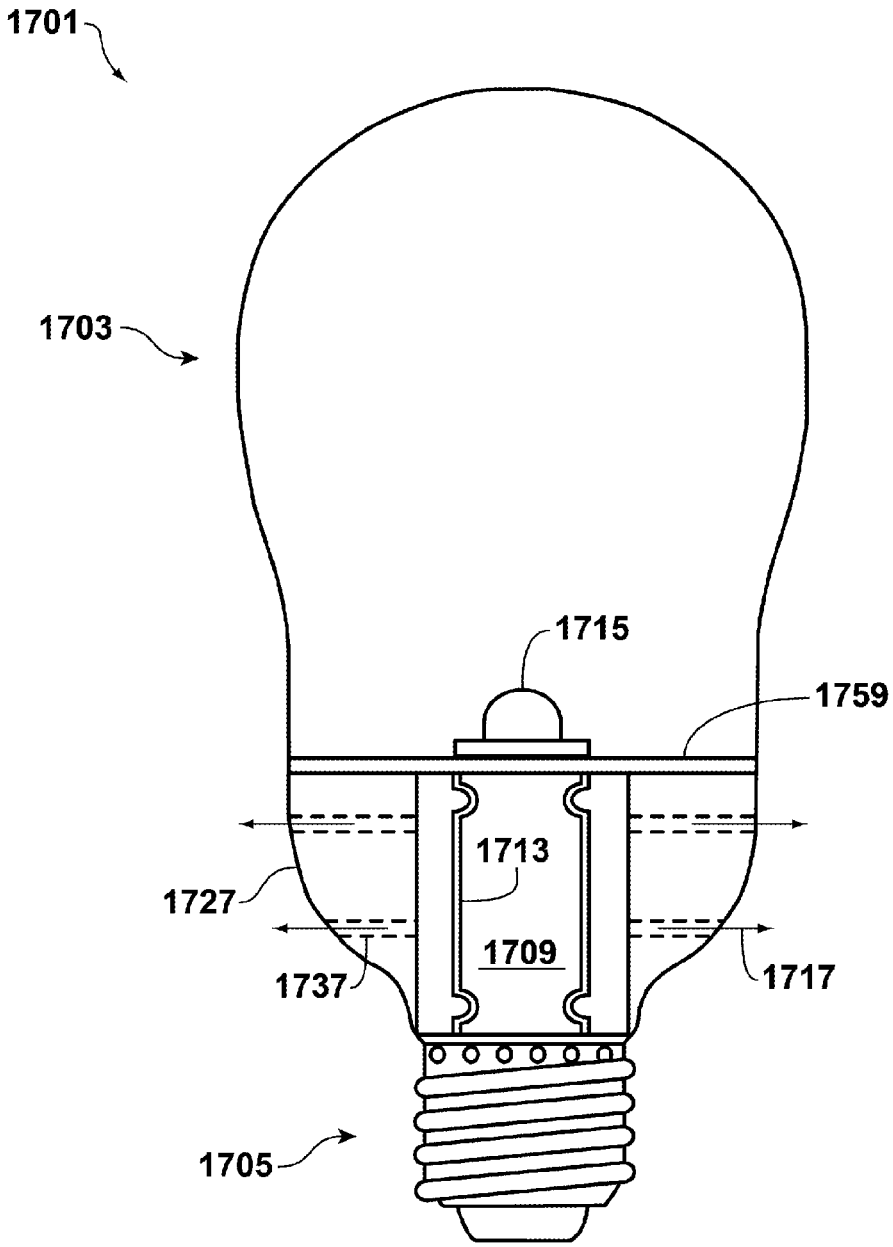
FIG. 22 is an illustration of an illumination device in accordance with the teachings herein.

FIG. 22 depicts another particular, non-limiting embodiment of an LED-based illumination device in accordance with the teachings herein. The illumination device 1701 depicted therein comprises a light-emitting portion 1703 which emits light, and a connector module 1705 which connects the illumination device 1705 to the electrical outlet of a light fixture. A synthetic jet ejector 1709 is disposed between the light emitting portion and the connector module 1705.

In this embodiment, the synthetic jet ejector 1709 is centrally disposed within a heat sink 1759 having a plurality of external heat fins 1727. The external heat fins 1727 have a plurality of channels 1737 defined therein which are in fluidic communication with the interior of the synthetic jet ejector 1709 and the external environment. An LED 1715 is disposed on top of the heat sink.

In operation, the heat sink 1759 absorbs heat given off by the LED 1715, and this heat is transferred to the heat fins 1727. The synthetic jet ejector 1709 creates a plurality of synthetic jets 1717 in the channels 1737 which rejects the heat to the external environment. As with the previous embodiment, the design of this illumination device 1701 allows for the use of relatively large diaphragms 1713 in the synthetic jet ejector 1709, which may be useful in achieving high heat flux from the heat sink 1759 to the external environment.

Figure 23:
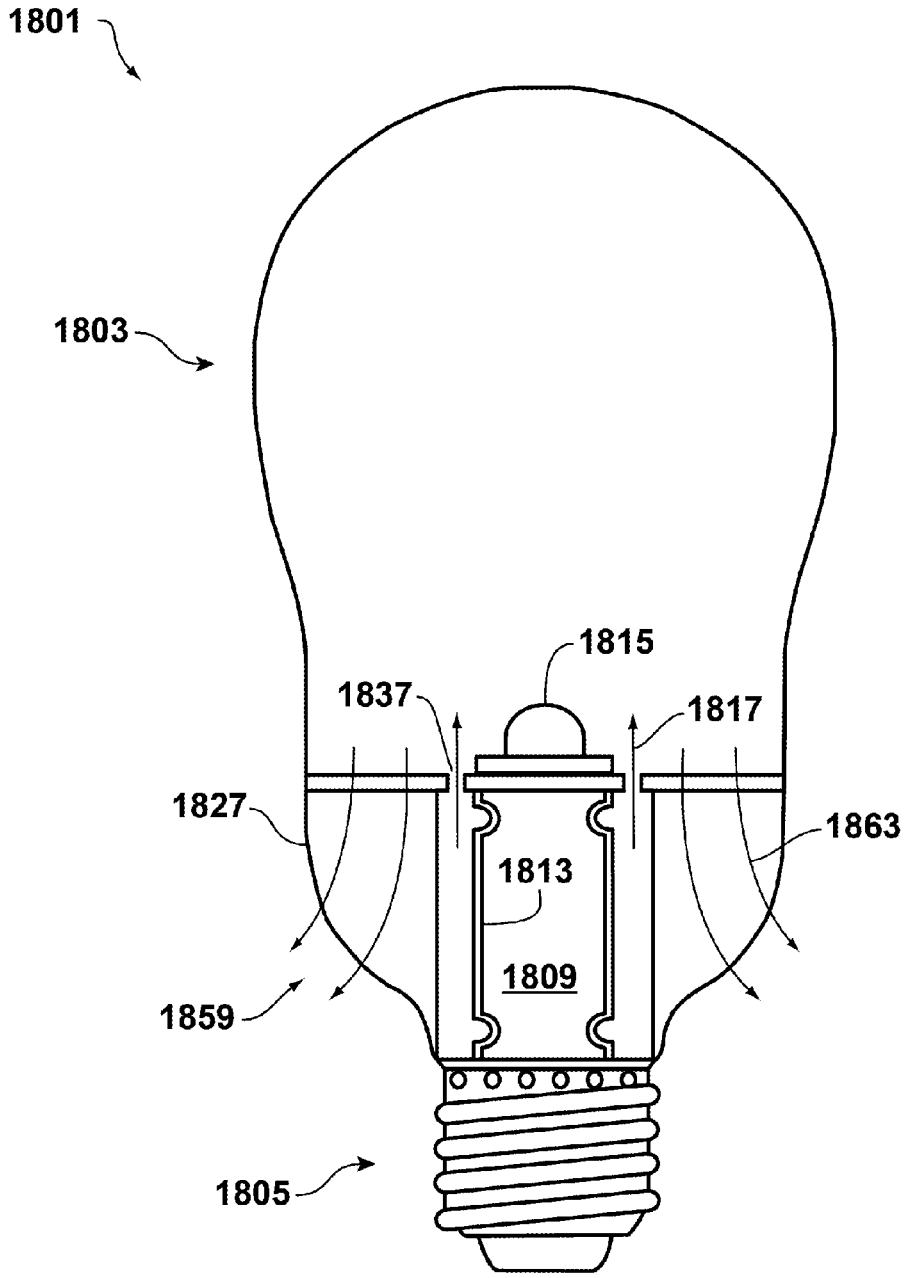
FIG. 23 is an illustration of an illumination device in accordance with the teachings herein.

FIG. 23 depicts another particular, non-limiting embodiment of an LED-based illumination device in accordance with the teachings herein. The illumination device 1801 depicted therein comprises a light-emitting portion 1803 which emits light, and a connector module 1805 which connects the illumination device 1801 to the electrical outlet of a light fixture. A synthetic jet ejector 1809 is disposed between the light emitting portion and the connector module 1805.

In this embodiment, the synthetic jet ejector 1809 is centrally disposed within a heat sink 1859 having a plurality of external heat fins 1827. The portion of the heat sink 1859 which separates the light emitting portion 1803 from the heat fins 1827 is porous, and hence provides for fluidic flow between the interior of the light emitting portion 1803 and the external environment as indicated by arrows 1863. This may be achieved, for example, by forming this portion of the heat sink 1859 out of a foamed, thermally conductive material, such as a foamed metal, or by providing a plurality of apertures or vents in this portion of the heat sink 1859. An LED 1815 is disposed on top of the heat sink 1859.

Similarly, the interior of the light emitting portion 1803 is in fluidic communication with the interior of the synthetic jet ejector 1809. This may be accomplished, for example, by seating the LED 1815 on a metal plate or heat spreader which is in thermal contact with the heat fins 1827, and which has a plurality of apertures 1837 therein adjacent to the LED 1815 which are in fluidic communication with the interior of the synthetic jet ejector 1809.

In operation, the heat sink 1859 absorbs heat given off by the LED 1815, and this heat is transferred to the heat fins 1847. The synthetic jet ejector 1809 emits a plurality of synthetic jets 1817 from the channels 1837, which in turn creates a flow of fluid across the heat fins 1827. The synthetic jets 1817 also facilitate the transfer of heat from the LED 1815 to the interior atmosphere of the light emitting portion 1803, where the warmed fluid can then exit the light emitting portion 1803 to the external environment as indicated by the arrows 1863. This fluidic flow also facilitates the transfer of heat from the heat fins 1827 to the external environment. As with the previous embodiment, the design of this illumination device 1801 allows for the use of relatively large diaphragms 1813 in the synthetic jet ejector 1809, which may be useful in achieving high heat flux from the heat sink 1859 to the external environment.

Figure 24:
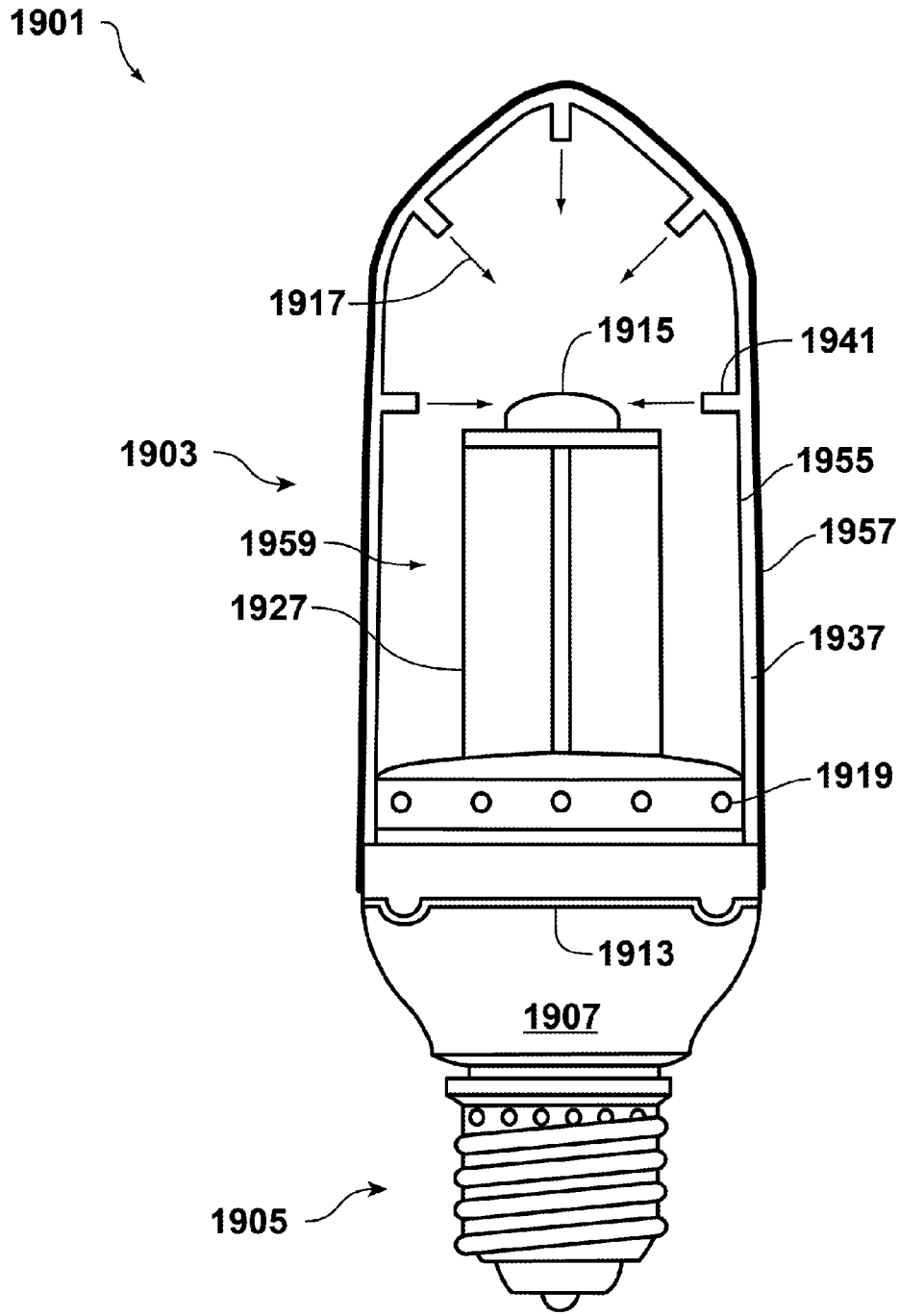
FIG. 24 is an illustration of an illumination device in accordance with the teachings herein.

FIG. 24 depicts a further particular, non-limiting embodiment of an LED-based illumination device in accordance with the teachings herein. The illumination device 1901 depicted therein comprises a light-emitting portion 1903 which emits light, and a connector module 1905 which connects the illumination device 1901 to the electrical outlet of a light fixture. A synthetic jet actuator 1907 is disposed between the light emitting portion 1903 and the connector module 1905.

The illumination device 1901 in this embodiment is equipped with a heat sink 1959 comprising a plurality of heat fins 1927, and upon which is disposed an LED 1915. The illumination device 1901 comprises an interior housing element 1955 and an exterior housing element 1957 which, between them, define a channel 1937 for fluidic flow. The channel 1937 is in fluidic communication with the synthetic jet actuator 1907 by way of a series of internal apertures 1909, and is further in fluidic communication with a plurality of nozzles 1941 disposed about the interior of the light emitting portion 1903.

In operation, the synthetic jet actuator 1907, which is driven by one or more diaphragms 1913, creates a plurality of synthetic jets 1917 at the nozzles 1941. The synthetic jets 1917 are directed at, or across, the surfaces of the LED 1915, and especially the light emitting surface thereon. The synthetic jets 1917 facilitate the transfer of heat from the LED 1915 to the interior atmosphere of the light emitting portion 1903, where it can be dissipated through thermal transfer to the internal 1955 and external 1957 housing elements and to the external environment, or through absorption by the heat sink 1959. The heat sink 1959 serves to absorb heat directly from the backside of the LED 1915. In some implementations of this embodiment, the heat sink 1959 may be equipped with one or more heat pipes.

Figure 25:
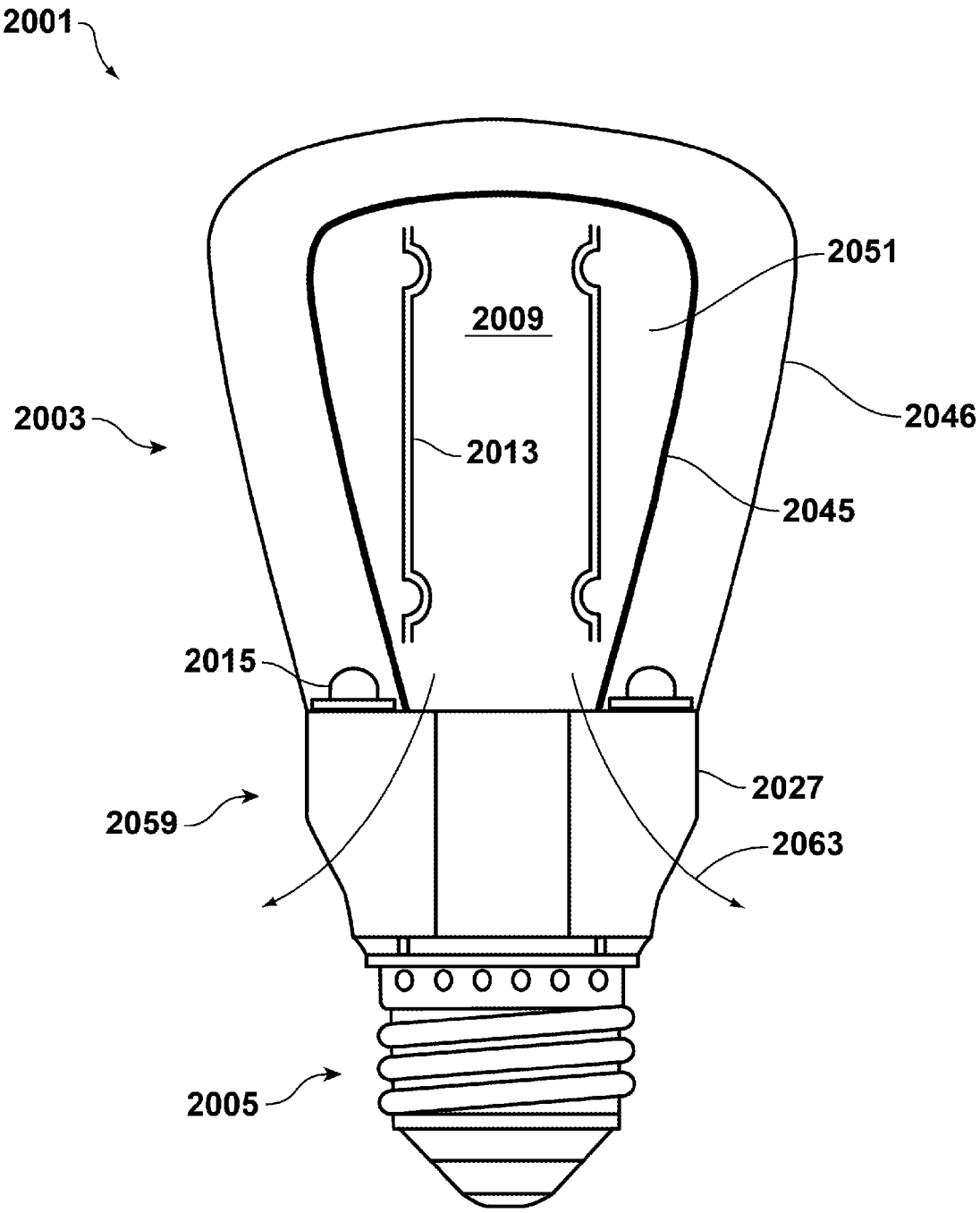
FIG. 25 is an illustration of an illumination device in accordance with the teachings herein.

FIG. 25 depicts a further particular, non-limiting embodiment of an LED-based illumination device in accordance with the teachings herein. The illumination device 2001 depicted therein comprises a light-emitting portion 2003 which emits light, a connector module 2005 which connects the illumination device 2001 to the electrical outlet of a light fixture, and a heat sink 2059 disposed between the two. A synthetic jet ejector 2009 equipped with a set of diaphragms 2013 is disposed in a central, internal chamber 2051 in the light emitting portion 2003 of the illumination device 2001. The internal chamber 2051 has a reflective surface 2045. A plurality of LEDs 2015 are disposed on the heat sink 2059 in the volume between the internal chamber 2045 and the exterior wall of the light emitting portion 2003.

In operation, the light emitted from the LEDs 2015 is reflected off of the reflective surface 2045 and is emitted through the exterior wall of the light emitting portion 2003. The degree of specular or diffuse reflectivity of these two surfaces may be selected to achieve a desired illumination footprint. Heat is withdrawn from the LEDs 2015 by the heat sink 2059. The synthetic jet ejector 2009 creates a fluidic flow across the surfaces of the heat fins 2027 as indicated by the arrows 2063, thus rejecting the heat to the external environment. Preferably, this flow 2063 is in the form of one or more synthetic jets.

Figure 26:
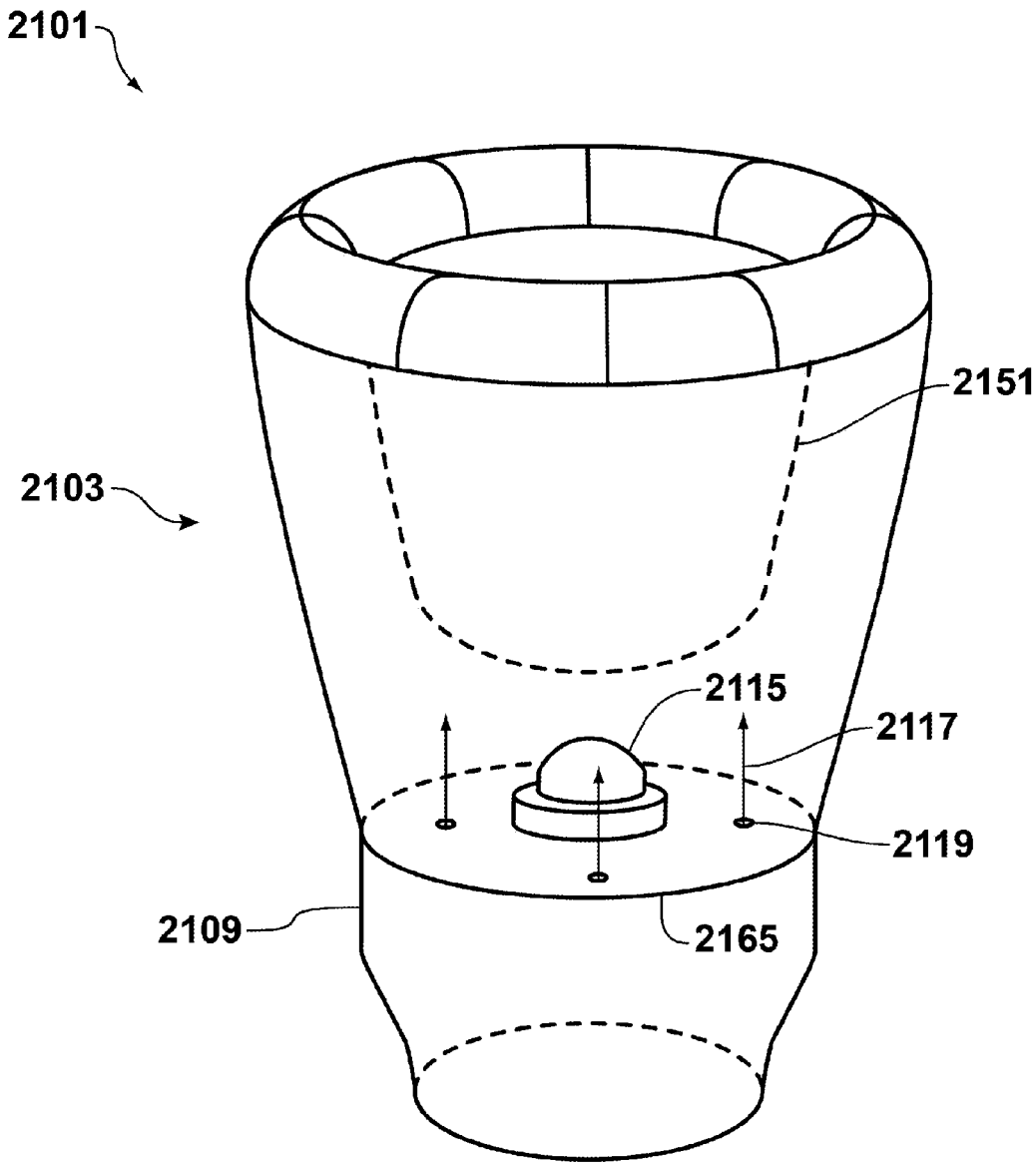
FIG. 26 is an illustration of an illumination device in accordance with the teachings herein.

FIG. 26 depicts another particular, non-limiting embodiment of an LED-based illumination device in accordance with the teachings herein. The illumination device 2101 depicted therein comprises a light-emitting portion 2103 which emits light, and a synthetic jet ejector 2109. The remaining elements of the illumination device have been omitted for clarity of illustration, but would typically include an electrical connector module and the operating components of the synthetic jet ejector 2109. The illumination device 2101 includes a heat spreader 2165 with a plurality of apertures 2119 defined therein. The globe 2157 of the light emitting portion 2103 is provided with a centrally disposed depression 2151 therein.

In use, the synthetic jet ejector 2109 creates a plurality of synthetic jets 2117 in the vicinity of the LED 2115. The synthetic jets impinge on the surface of the depression 2151, and thus aid in the transfer of heat from the interior of the light emitting portion 2103 to the external environment.

Figure 27:
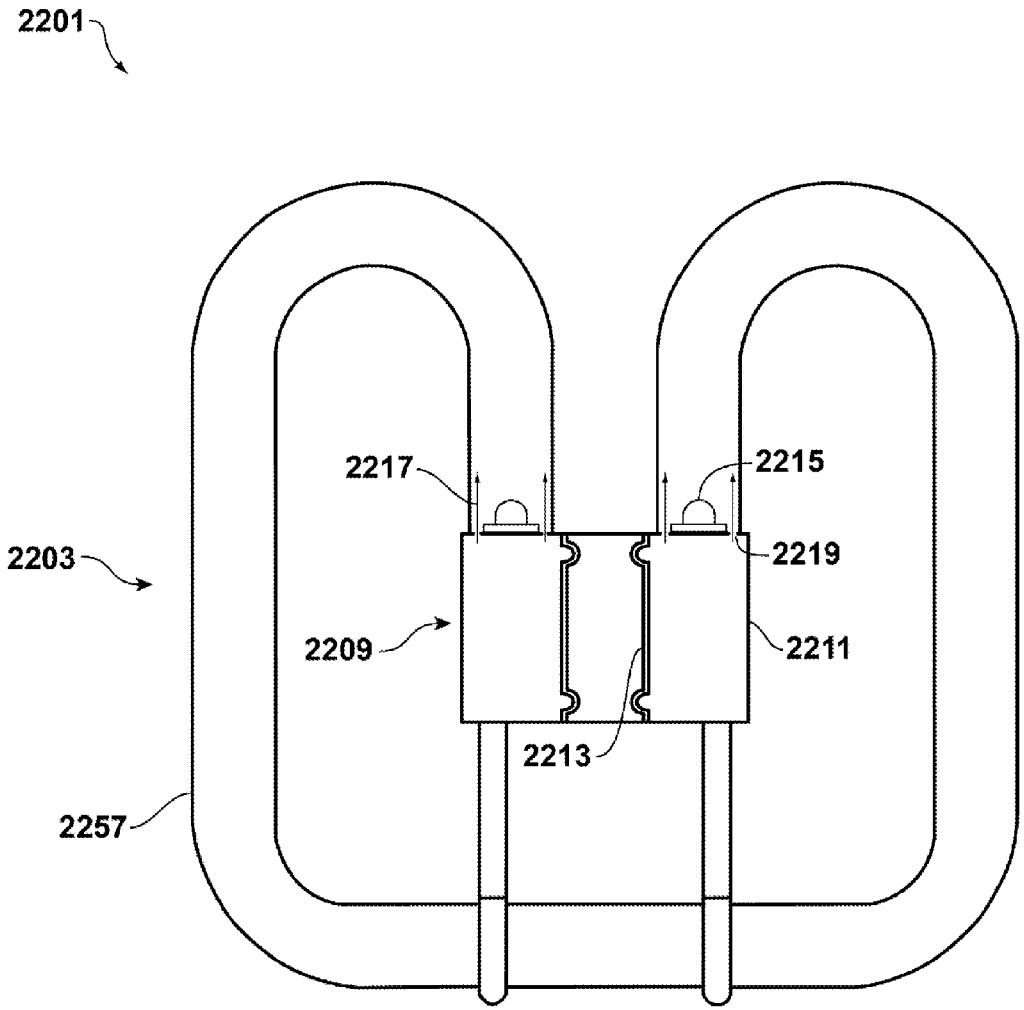
FIG. 27 is an illustration of an illumination device in accordance with the teachings herein.

FIG. 27 depicts another particular, non-limiting embodiment of an LED-based illumination device in accordance with the teachings herein, which in this case is a tubular illumination device similar to the type used in fluorescent lamps. The illumination device 2201 depicted therein comprises a light-emitting portion 2203 which emits light, and a synthetic jet actuator 2209 equipped with a set of diaphragms 2213. An LED 2015 is disposed at each end of the tubing 2257 forming the light emitting portion 2203, and has a set of apertures 2219 disposed adjacent thereto which permit a fluidic flow about the LED 2213 and into the tubing 2257 of the light emitting portion 2203.

In operation, the synthetic jet ejector 2209 creates a fluidic flow about the LEDs 2215 in the form of one or more synthetic jets 2217. This flow transfers heat from the LEDs 2213 to the surfaces of the tubing 2257 of the light emitting portion 2203, where it is rejected to the external atmosphere.

Figure 28:
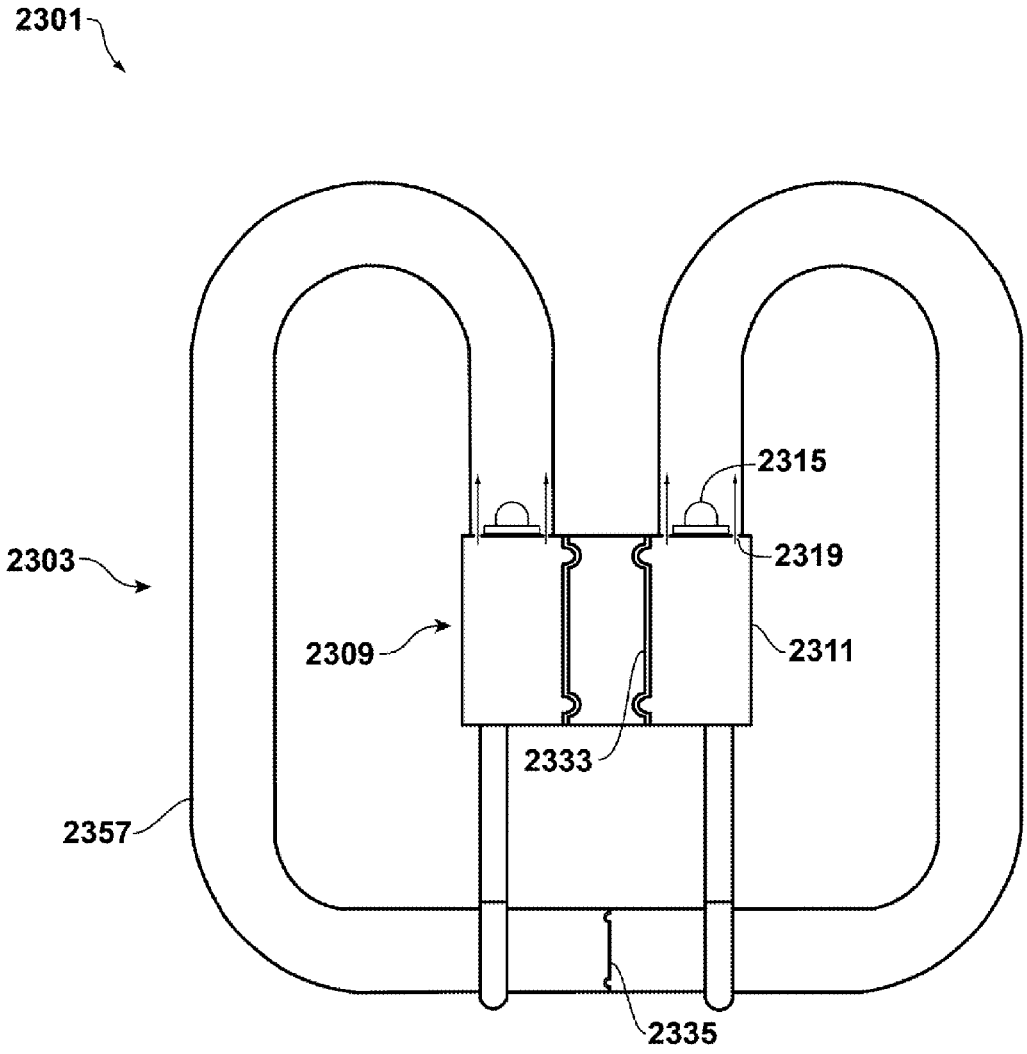
FIG. 28 is an illustration of an illumination device in accordance with the teachings herein.

FIG. 28 depicts another particular, non-limiting embodiment of an LED-based illumination device in accordance with the teachings herein. The illumination device 2301 depicted therein is similar in most respects to the embodiment depicted in FIG. 27, and hence comprises a light-emitting portion 2303 which emits light, and a synthetic jet actuator 2309 equipped with a set of diaphragms 2313. An LED 2315 is disposed at each end of the tubing 2357 forming the light emitting portion 2303, and has a set of apertures 2319 disposed adjacent thereto which permit a fluidic flow about the LED 2315 and into the tubing 2357 of the light emitting portion 2303. In addition, however, the illumination device 2301 of this embodiment is equipped with a passive diaphragm 2335 which operates in a manner similar the passive diaphragm 2335 in the embodiment of FIG. 9.

In operation, the synthetic jet ejector 2309 creates a fluidic flow about the LEDs 2315 in the form of one or more synthetic jets 2317. This flow transfers heat from the LEDs 2315 to the surfaces of the tubing 2357 of the light emitting portion 2303, where it is rejected to the external atmosphere.

Figure 29:
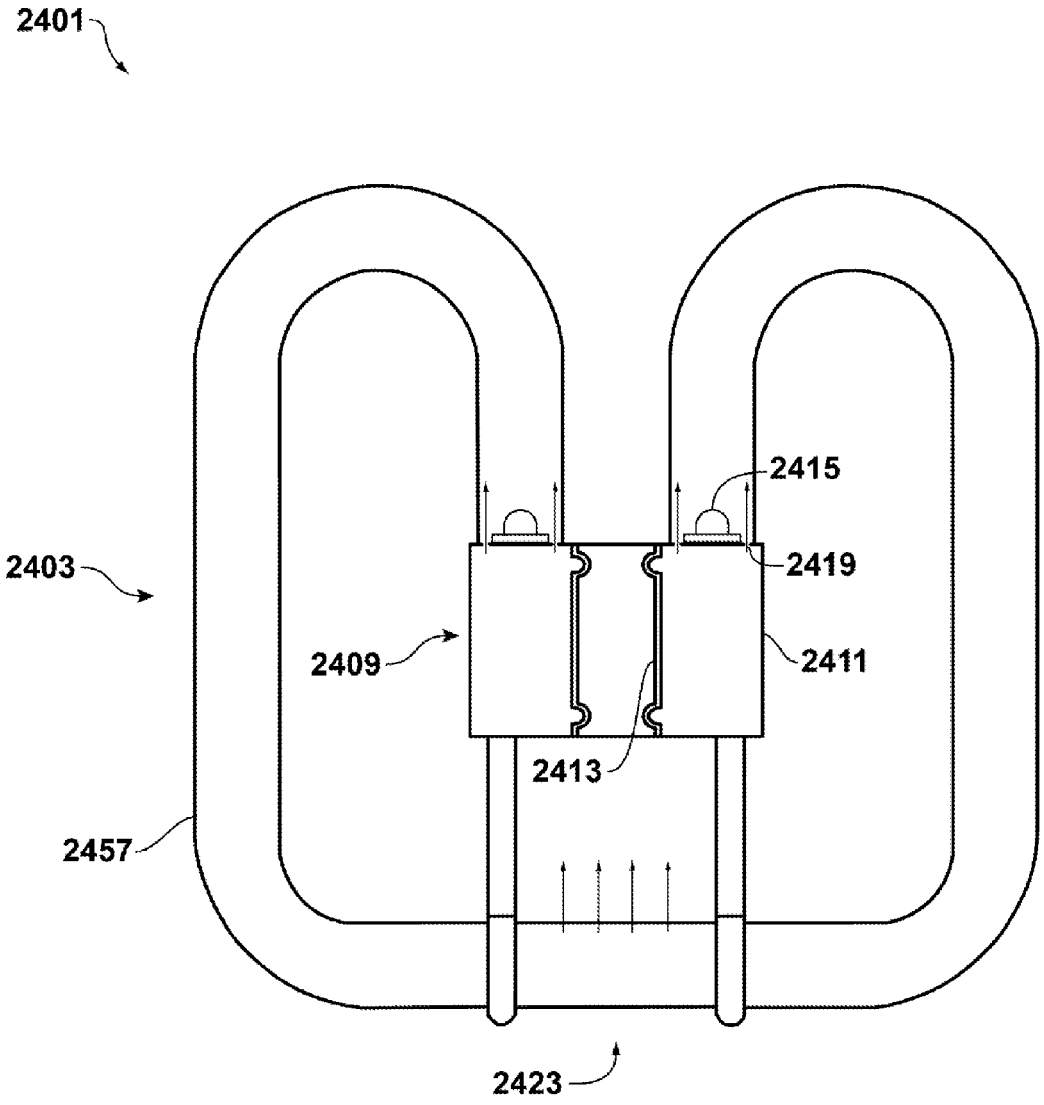
FIG. 29 is an illustration of an illumination device in accordance with the teachings herein.

FIG. 29 depicts another particular, non-limiting embodiment of an LED-based illumination device in accordance with the teachings herein. The illumination device 2401 depicted therein is similar in most respects to the embodiment depicted in FIG. 27, and hence comprises a light-emitting portion 2403 which emits light, and a synthetic jet actuator 2409 equipped with a set of diaphragms 2413. An LED 2415 is disposed at each end of the tubing 2457 forming the light emitting portion 2403, and has a set of apertures 2419 disposed adjacent thereto which permit a fluidic flow about the LED 2415 and into the tubing 2457 of the light emitting portion 2403. In addition, however, this embodiment is equipped with an external vent 2423 disposed in a central location on the tubing 2457 which forms the light emitting portion 2403.

In operation, the synthetic jet ejector 2409 creates a fluidic flow about the LEDs 2415 in the form of one or more synthetic jets 2417. This flow transfers heat from the LEDs 2415 to the surfaces of the tubing 2457 of the light emitting portion 2403, where it is rejected to the external atmosphere. The external vent 2423 provides an additional means by which heat may be rejected to the external environment.

In some variations of this embodiment, the illumination device 2401 may be adapted to emit synthetic jets from the external vent 2423. In other variations, the synthetic jet ejector provides a fluidic flow around the LEDs 2415, but only emits synthetic jets at the external vent 2423.

Reflective Materials

The various embodiments of light fixtures disclosed herein may be equipped with various reflective materials or surfaces. These include, without limitation, specularly or diffusely reflective or scattering materials. Such materials may be applied to the intended substrate as coatings or films. In some implementations, these coatings or films may be formed and then applied to the substrate, while in other implementations, they may be formed on the substrate in situ.

Examples of such scattering films include those based on continuous/disperse phase materials. Such films may be formed, for example, from a disperse phase of polymeric particles disposed within a continuous polymeric matrix. In some embodiments, one or both of the continuous and disperse phases may be birefringent. Such a film may be oriented, typically by stretching, in one or more directions. The size and shape of the disperse phase particles, the volume fraction of the disperse phase, the film thickness, and the amount of orientation may be chosen to attain a desired degree of diffuse reflection and total transmission of electromagnetic radiation of a desired wavelength in the resulting film. Films of this type, and methods for making them, are described, for example, in U.S. Pat. No. 6,031,665 (Carlson et al.), which is incorporated herein by reference in its entirety. Analogous films in which the disperse phase comprises inorganic or non-polymeric materials (such as, for example, silica, alumina, or metal particles) may also be utilized in the devices and methodologies described herein.

Reflective surfaces may also be imparted to the devices described herein through suitable metallization. These include, for example, films of silver or other metals which may be formed through vapor or electrochemical deposition.

Electrical Outlets

The various embodiments of light fixtures disclosed herein may be equipped with various electrical connectors. These include, without limitation, threaded connectors that rotatingly engage complimentary shaped sockets in an electrical outlet; prong connectors, which may be male or female, and which mate with complimentary shaped prongs or receptacles in an electrical outlet; cord connectors; and the like. The choice of connector may vary from one application to another and may depend, for example, on the wattage output of the light fixture and other such considerations as are known to the art. It will be understood, however, that while embodiments of light fixtures may have been disclosed or illustrated herein as having a particular connector type, any other suitable connector, including those described above, may be substituted where suitable for a particular application.

Bulb Coatings/Pigments

The various embodiments of light fixtures disclosed herein may be equipped with various bulbs. These bulbs, or any portion thereof, may be clear, opaque, specularly or diffusively transmissive, specularly or diffusively reflective, polarizing, mirrored, colored, or any combination of the foregoing. In some embodiments, the bulb may also be equipped with a film or pigment which provides the light fixture with a desired optical footprint. These bulbs may also be equipped with any of the various types of phosphors as are known to the art, or with various combinations of such phosphors.

Synthetic Jet Actuators/Ejectors

Various synthetic jet actuators and synthetic jet ejectors may be utilized in the devices and methodologies described herein. Preferably, however, the synthetic jet actuators and synthetic jet ejectors are of the type described in U.S. Ser. No. 61/304427, entitled "SYNTHETIC JET EJECTOR AND DESIGN THEREOF TO FACILITATE MASS PRODUCTION" (Grimm et al.), which is incorporated herein by reference in its entirety. These synthetic jet actuators and synthetic jet ejectors may have various sizes, dimensions and geometries, and hence may be adapted to spaces available in the host device. Hence, for example, the synthetic jet ejector may be cylindrical, parallelepiped, or irregular in shape.

Figure 30:
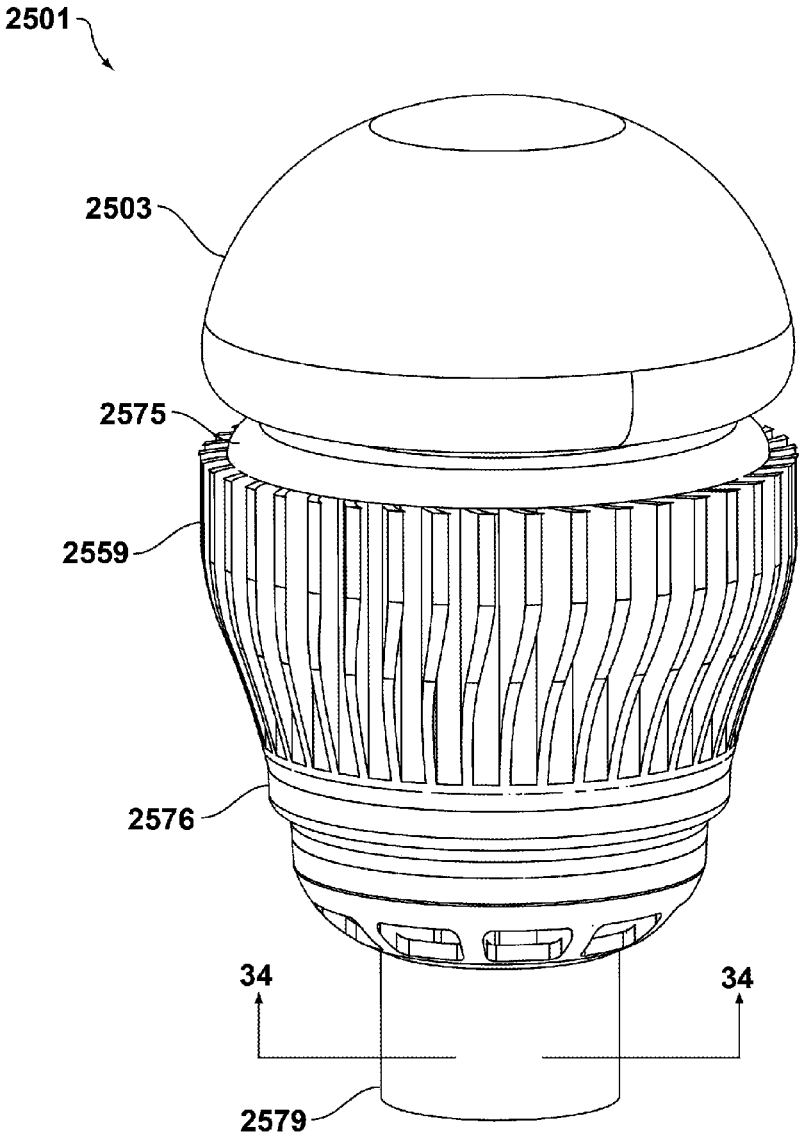
FIG. 30 is an illustration of an illumination device in accordance with the teachings herein.
Figure 31:
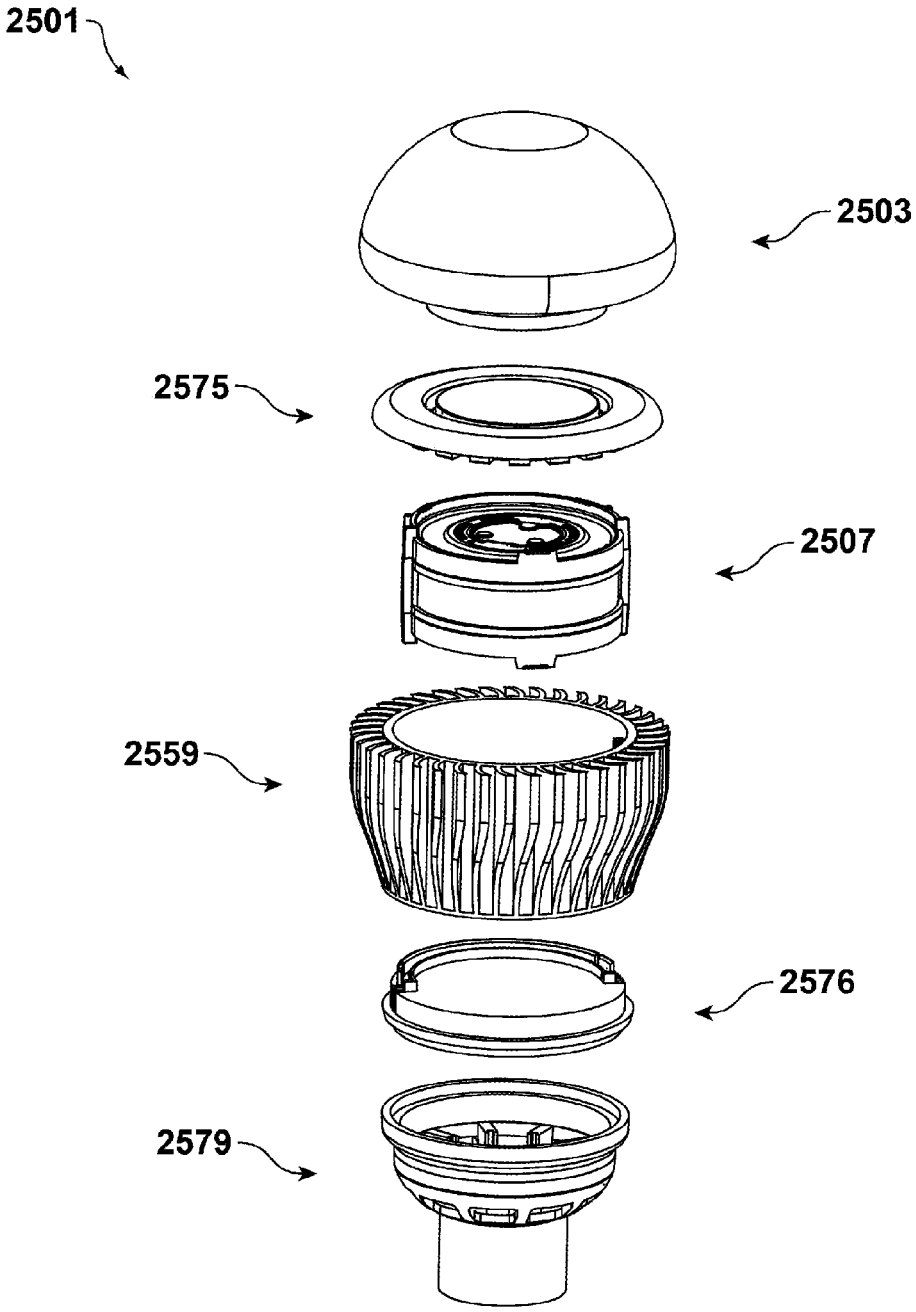
FIG. 31 is an exploded view of the illumination device of FIG. 30.
Figure 32:
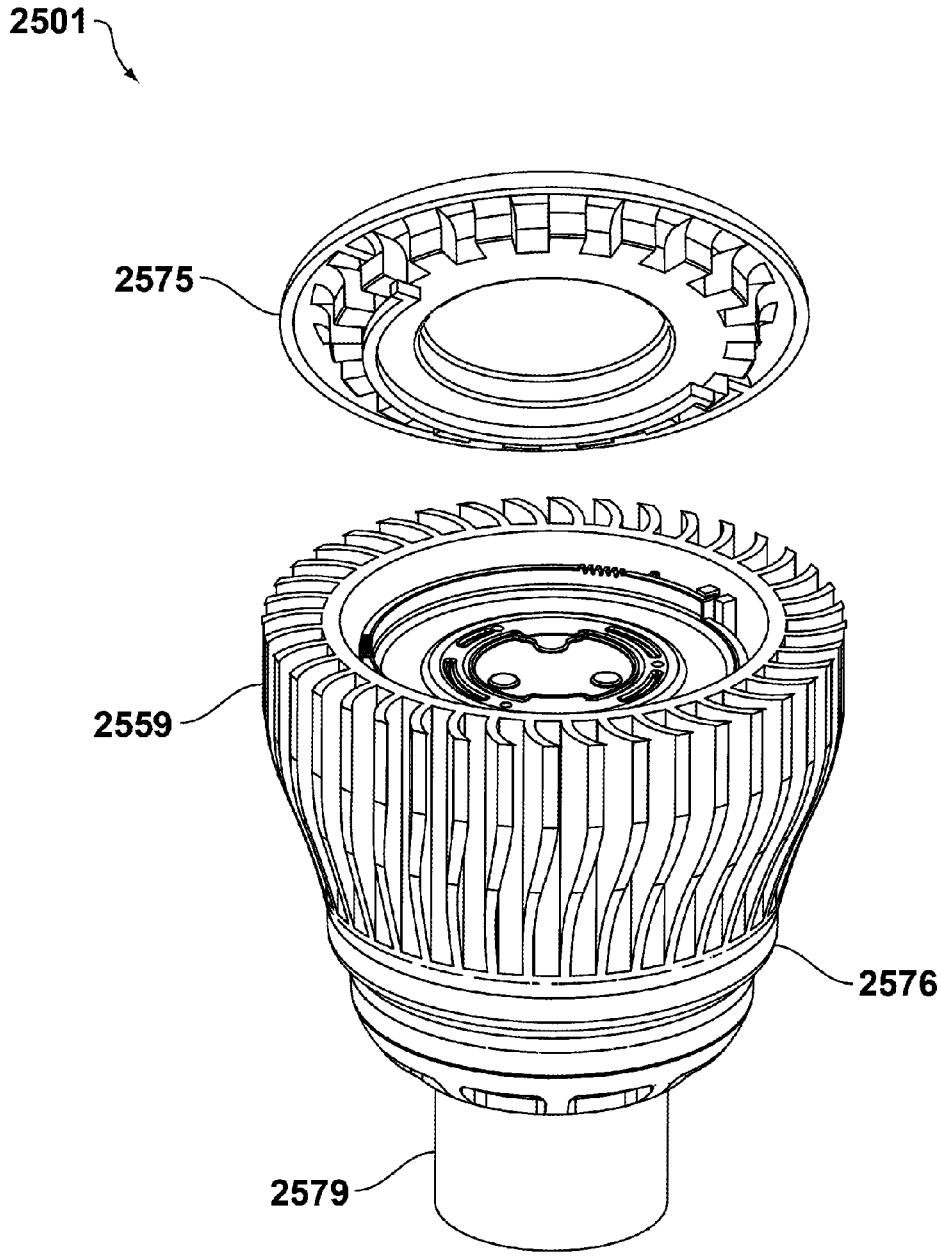
FIG. 32 is an illustration of the illumination device of FIG. 30 depicting the manner in which the upper wall integrates with the heat sink to form flow paths.

FIG. 30 depicts a particular, non-limiting embodiment of such a synthetic jet ejector 2509 and its application in an illumination device 2501. The illumination device 2501 comprises a light-emitting portion 2503, a heat sink 2559 (which, in this embodiment, is integral with the housing) having a synthetic jet actuator 2507 (see FIG. 31) disposed therein, an upper wall 2575, a lower wall 2576, and a base 2579.

Figure 33:
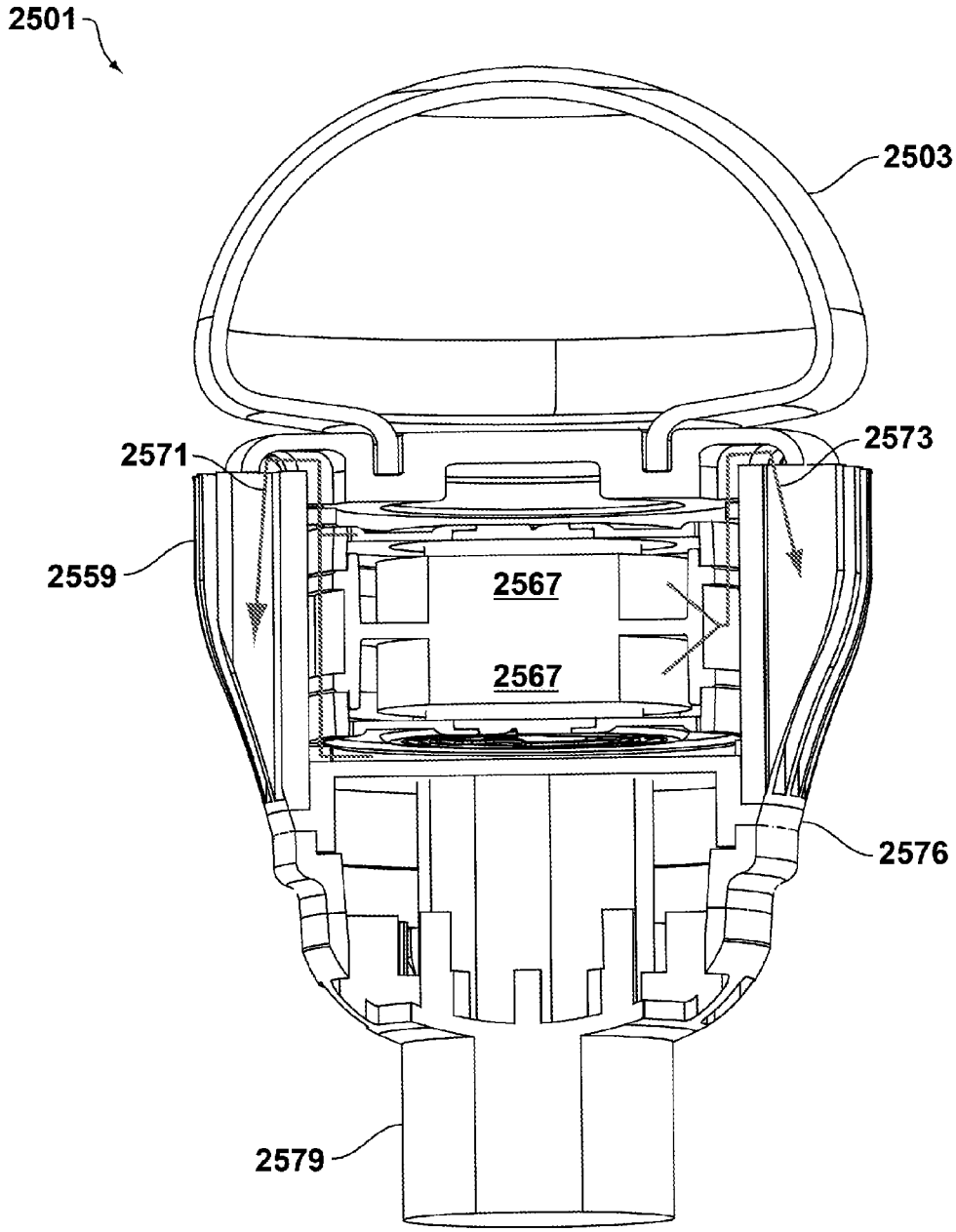
FIG. 33 is a cross-sectional view taken along LINE 33-33 of the illumination device of FIG. 30 depicting the flow paths between the synthetic jet actuators and the heat sink.

As best seen in FIG. 33, the synthetic jet ejector 2509 comprises first and second voice coils 2567 which drive first and second diaphragms 2569. The synthetic jet ejector 2509 has first 2571 and second 2573 channels defined therein which are in fluidic communication with a heat sink 2559.

Notably, in the particular illumination device 2501 depicted, elements of the host illumination device 2501 define the housing of the synthetic jet ejector 2509. Consequently, the overall space occupied by the synthetic jet ejector 2509 is significantly reduced compared to the situation that would exist if the synthetic jet ejector was made as a standalone unit (with its own housing) and subsequently incorporated into the host device. Moreover, in this embodiment, the upper wall 2575 (see FIG. 30) is thermally conductive and is in thermal communication with the heat sink fins 2527, and hence forms part of the heat sink 2559. This allows the synthetic jet ejector 2509 to absorb a greater amount of heat, distribute it over a larger area, and disperse it to the external atmosphere with the fluidic flow used to create synthetic jets 2517. As a further advantage, the synthetic jets 2517 further help to dissipate heat to the external environment by disrupting the boundary layer at the surfaces of the fins 2527 of the synthetic jet ejector 2529.

Heat Sinks

The various illumination devices described herein may be equipped with heat sources of various sizes, shapes and geometries. These heat sinks may be readily adapted to the space available within the illumination device or external to it. In some embodiments, these heat sinks may comprise a plurality of heat fins.

Figure 14:
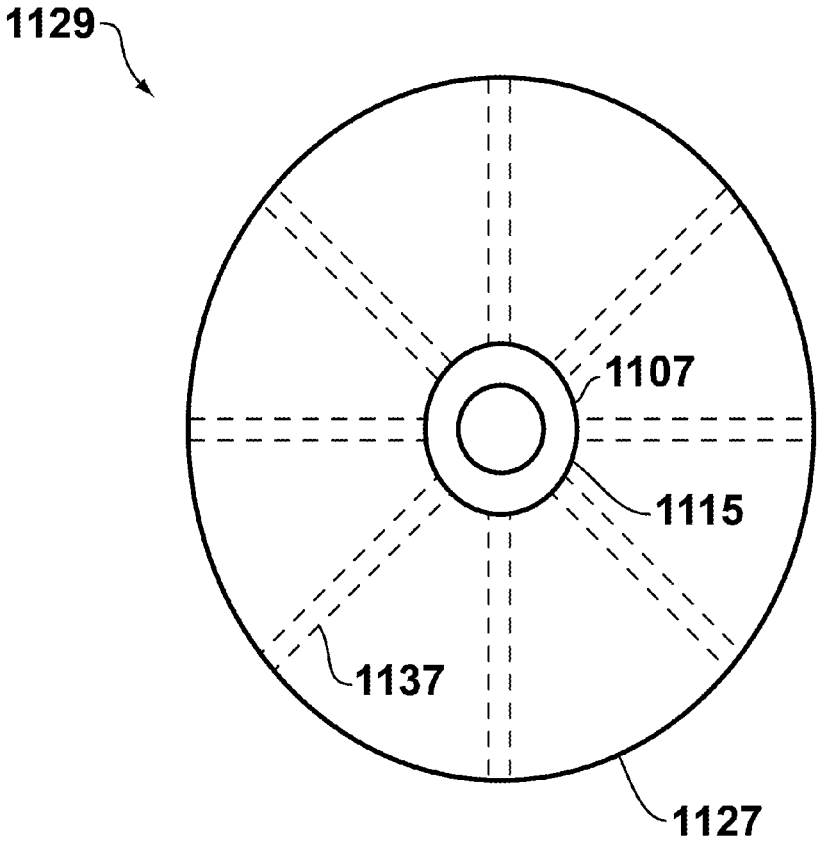
FIG. 14 is an illustration of the synthetic jet ejector/heat sink combination utilized in the illumination device of FIG. 13.

In some applications, it may be desirable to mount the heat sink on the exterior of a illumination device. Examples of such embodiments may be found in FIGS. 10, 11 and 12. As illustrated in the embodiment of FIGS. 13 and 14, however, the surface created by the heat fins may be covered by a smooth surface equipped with a plurality of apertures. Such a surface permits a fluidic flow between The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

APPENDIX A

Parts List

01: Illumination device
03: Light Emitting Portion
05: Electrical Connector Module
07: Synthetic Jet Actuator
09: Synthetic Jet Ejector
11: Actuator Housing
13: Diaphragm
15: LED
17: Synthetic Jet
19: Internal Aperture
20: Aperture in Actuator Housing
21: External Aperture
23: External Vent
25: Pedestal
27: Heat Fin

29: Synthetic Jet Ejector/Heat Sink Combination
31: LED Support Structure
33: Active Diaphragm
35: Passive Diaphragm
37: Channel
39: Externally Mounted LED
41: Nozzle
43: Synthetic Jet Actuator Support Structure
45: Reflective Material
47: Porous Medium
49: Heat Pipe
51: Internal Chamber
53: Region
55: Internal Housing Element
57: External Housing Element
59: Heat Sink
63: Arrow
65: Heat Spreader
67: Voice Coils
69: Diaphragm
71: $1^{st}$ Channel
73: $2^{nd}$ Channel
75: Upper Wall
76: Lower Wall
77: Heat Sink Cover
79: Base

What is claimed is:

1. An illumination device, comprising:
a first housing;
a pedestal disposed in said first housing;
a synthetic jet ejector supported by said pedestal; and
at least one LED supported by said synthetic jet ejector.

2. The illumination device of claim 1, wherein said synthetic jet ejector has first and second opposing surfaces having first and second LEDs, respectively, disposed thereon.

3. The illumination device of claim 2, wherein said synthetic jet ejector has third and fourth opposing surfaces having third and fourth LEDs, respectively, disposed thereon.

4. The illumination device of claim 1, wherein said synthetic jet ejector is essentially polyhedral in shape, wherein said synthetic jet ejector is attached to said pedestal across a first face of said polyhedron, and wherein at least one LED is disposed on each of the remaining faces of said polyhedron.

5. The illumination device of claim 1, wherein said LED is supported on a surface of said synthetic jet ejector, and wherein said synthetic jet ejector is adapted to emit a plurality of synthetic jets across said surface and adjacent to said LED.

6. The illumination device of claim 1, wherein said synthetic jet ejector has first and second diaphragms, wherein said pedestal has a longitudinal axis, and wherein said first and second diaphragms are oriented perpendicular to said longitudinal axis.

7. The illumination device of claim 1, further comprising:
a threaded connector module adapted to rotatingly engage said illumination device to a source of electricity.

8. The illumination device of claim 1, wherein said synthetic jet ejector contains a plurality of apertures, and wherein said at least one LED is disposed adjacent to at least one of said plurality of apertures.

9. The illumination device of claim 1, wherein said pedestal comprises a heat pipe.

10. The illumination device of claim 9, further comprising a threaded connector module portion adapted to rotatingly engage said illumination device to a source of electricity, and wherein one end of said heat pipe terminates in said connector module portion.

11. The illumination device of claim 1, wherein said synthetic jet ejector contains an active diaphragm and a passive diaphragm, and wherein said at least one LED is disposed between the active diaphragm and the passive diaphragm.

12. The illumination device of claim 11, wherein at least one of said active and passive diaphragms has a reflective surface.

13. The illumination device of claim 11, wherein at least one of said active and passive diaphragms has a surface which is reflective to the radiation emitted by said LED.

14. The illumination device of claim 13, wherein said reflective surface is specularly reflective.

15. The illumination device of claim 13, wherein said reflective surface is diffusely reflective.

16. The illumination device of claim 1, wherein said first housing is transparent or translucent to the light emitted by said at least one LED.

17. The illumination device of claim 1, wherein said first housing emits light.

18. The illumination device of claim 1, wherein said synthetic jet ejector comprises a second housing with first and second diaphragms disposed therein.

19. The illumination device of claim 18, wherein at least one of said first and second diaphragms has a reflective surface.

20. The illumination device of claim 18, wherein at least one of said first and second diaphragms has a surface which is reflective to the radiation emitted by said LED.

21. The illumination device of claim 20, wherein said reflective surface is specularly reflective.

22. The illumination device of claim 20, wherein said reflective surface is diffusely reflective.

23. The illumination device of claim 18, further comprising first and second coils which drive said first and second diaphragms.

24. The illumination device of claim 18, wherein said first diaphragm is an active diaphragm, and said second diaphragm is a passive diaphragm, and wherein said first diaphragm is in fluidic communication with said second diaphragm.

25. The illumination device of claim 1, wherein said at least one LED comprises a plurality of LEDS, and wherein said synthetic jet ejector is essentially polyhedral in shape, wherein each of said plurality of LEDs is disposed on a face of said polyhedron.

26. The illumination device of claim 25, wherein said synthetic jet ejector contains a plurality of apertures, wherein a synthetic jet is ejected from each of said plurality of apertures, and wherein each face of said polyhedron that has an LED disposed thereon also has at least one of said plurality of apertures therein.

27. The illumination device of claim 26, wherein each face of said polyhedron that has an LED disposed thereon is a polygon and has the LED centered on the polygon, and wherein one of said plurality of apertures is disposed adjacent to each of the vertices of said polygon.

28. The illumination device of claim 1, wherein said synthetic jet ejector contains a plurality of apertures, wherein a synthetic jet is ejected from each of said plurality of apertures, and wherein each LED of said at least one LED is disposed adjacent to at least one of said plurality of apertures.

* * * * *